US009434519B2

(12) United States Patent
Stripp

(10) Patent No.: US 9,434,519 B2
(45) Date of Patent: Sep. 6, 2016

(54) DISPENSING CAP

(71) Applicant: H2M Beverages, LLC, Lebanon, NJ (US)

(72) Inventor: Steven G. Stripp, Bridgewater, NJ (US)

( * ) Notice: Subject to any disclaimer, the term of this patent is extended or adjusted under 35 U.S.C. 154(b) by 0 days.

(21) Appl. No.: 14/561,966

(22) Filed: Dec. 5, 2014

(65) Prior Publication Data

US 2015/0314930 A1 Nov. 5, 2015

Related U.S. Application Data

(60) Provisional application No. 61/987,770, filed on May 2, 2014, provisional application No. 62/029,022, filed on Jul. 25, 2014.

(51) Int. Cl.
*B65D 47/20* (2006.01)
*B65D 51/28* (2006.01)

(52) U.S. Cl.
CPC ..... *B65D 51/2871* (2013.01); *B65D 47/20* (2013.01); *B65D 51/2892* (2013.01)

(58) Field of Classification Search
CPC .. B65D 23/00; B65D 47/20; B65D 51/2864; B65D 51/2878; B65D 51/2892; B65D 51/2857; B65D 51/2807; B65D 41/00; B65D 41/04; B65D 41/0414; B65D 41/0442; B67D 99/00; Y10S 215/08
See application file for complete search history.

(56) References Cited

U.S. PATENT DOCUMENTS 3,443,726 A 5/1969 Muller et al.
4,386,696 A 6/1983 Goncalves
4,793,475 A 12/1988 Itzel
5,139,182 A * 8/1992 Appla ..... 222/519
5,419,445 A * 5/1995 Kaesemeyer ..... A61J 1/2093 206/220
5,950,819 A 9/1999 Sellars
6,073,803 A 6/2000 Sturm et al.
6,655,524 B2 12/2003 De Laforcade
6,921,087 B2 7/2005 Takahashi et al.
7,172,095 B2 * 2/2007 Marshall ..... B65D 51/2892 206/219
7,347,322 B2 3/2008 Cho
7,617,929 B2 11/2009 Lee et al.
7,789,854 B2 9/2010 Talamonti
8,104,610 B2 1/2012 Lee et al.
9,242,783 B2 * 1/2016 Cho ..... B65D 51/2892
2004/0060831 A1 4/2004 De Laforcade
2005/0115845 A1 * 6/2005 Cho ..... 206/216
2005/0211579 A1 9/2005 Makita
2009/0139882 A1 * 6/2009 DeJonge ..... 206/219
2009/0308831 A1 12/2009 Anderson
2011/0290824 A1 12/2011 Smith et al.
2013/0240533 A1 9/2013 Cho

FOREIGN PATENT DOCUMENTS

JP 2006076652 3/2006

* cited by examiner

*Primary Examiner* — Nicholas J Weiss
(74) *Attorney, Agent, or Firm* — Nath, Goldberg & Meyer; Jerald L. Meyer

(57) ABSTRACT

The non-limiting embodiments described herein disclose a container and a cap. The cap seals a container while providing a separate internal storage area for liquid or power contents. A seal disposed at the bottom of the cap ensures that the storage area contents remain fresh and sterile until the cap is rotated to release the seal. The clockwise rotation and threaded engagement of the storage area with the lower cylindrical collar and the upper cylindrical collar releases the seal from the bottom of the cap, while centrifugal forces within the cap urge the storage area contents into the container.

15 Claims, 22 Drawing Sheets

DISPENSING CAP

RELATED APPLICATION

The present Patent Application claims priority to Provisional Patent Application No. 61/987,770 filed May 2, 2014, which is assigned to the assignee hereof and filed by the inventors hereof, and which is incorporated by reference herein.

BACKGROUND

1. Field

The present subject matter relates to a dispensing cap including a storage area for storing liquid or powder contents separate from a container or bottle. More specifically, the subject matter relates to a threaded dispensing cap arranged to rotate to an open position and release a seal so that the contents of the storage area incur centrifugal forces and dispense the liquid or powder into an attached container or bottle.

2. Background

Many containers do not include a storage area inside of a threaded cap or an arrangement for a simple release of the storage area contents by merely rotating the cap in a clockwise direction. Furthermore, containers or bottles in the market today that include a storage area inside of a cap suffer from significant drawbacks. U.S. Pat. Nos. 4,386,696, 5,950,819, 6,073,803 and 6,921,087 are representative of such containers. The challenges presented by these containers include maintaining proper sealing of the cap's storage area, a tamper-resistant arrangement, and a simple threaded arrangement that provides lower production costs and ease of manufacture.

SUMMARY

The non-limiting embodiments described herein disclose a container dispensing cap (also referred to as "cap"). The dispensing cap is threaded and seals a container while providing a storage area for liquid or powder contents. By providing a storage area separate from the container, the dispensing cap keeps the liquid or power contents fresh, sterile, and in a homogeneous state. The storage area contents and container contents can be mixed without exposure to ambient air prior to dispensing the mixed contents.

According to one embodiment, the dispensing cap includes a number of components including a dispensing member assembled inside the top of the cap. The dispensing member includes an aperture for dispensing the combined contents of the cap and the container by pulling the dispensing member in an upward direction, much like a sports or water bottle, to a height above a static plug. The static plug is centrally positioned inside of the dispensing member to ensure that the container and cap contents are not dispensed when the dispensing member is at a height below the static plug.

Further, according to an embodiment, the cap includes a body with a storage area that has an outer threaded side wall and cylindrical collars that have internal threaded side walls. The storage area and cylindrical collars are arranged to be in threaded engagement with one another. By simply rotating an upper cylindrical collar in a clockwise and a counterclockwise direction, the outer threaded side wall of the storage area and the inner threaded walls of the lower and upper cylindrical collars engage and disengage, respectively. When the upper cylindrical collar is rotated, the upper cylindrical collar's textured surface provides a gripping mechanism for ease of rotating the upper cylindrical collar in the clockwise and counterclockwise directions.

According to an embodiment, the cap also includes a lower cylindrical collar that has an internal or inner threaded side wall. To seal the container, the lower cylindrical collar rotates in a clockwise direction around a threaded top portion or mouth of the container. In order to open the container, the lower cylindrical collar rotates in a counterclockwise direction around the container top or mouth. This threaded engagement of the lower cylindrical collar and the container threaded top portion ensure that the container is properly sealed.

In an embodiment, the storage area that is assembled inside of the cap ensures that the liquid or power contents remains sealed, until the seal is broken and the contents are released from the storage area. The seal is disposed at the bottom of the storage area and configured to release from the storage area when the upper cylindrical collar is rotated in a clockwise direction. During this rotational movement, centrifugal forces within the cap urge the storage area liquid or power contents from the storage area and into the container.

In a further embodiment, the cap includes a seal that is completely released from the storage area. The clockwise rotation and threaded engagement of the storage area with the lower cylindrical collar and the upper cylindrical collar of the cap releases the seal from the storage area, such that centrifugal forces within the cap urge the storage area liquid or power contents from the storage area and into the container. According to this embodiment, substantially all of the storage area contents are directly released in a downward direction into the container, and the seal is released in a downward direction into the container.

In another embodiment, the cap includes a seal that is released from the storage area but does not completely separate from the cap and fall into the container below. In this embodiment, the clockwise rotation and threaded engagement of the storage area with the lower cylindrical collar and the upper cylindrical collar releases the seal from the storage area such that centrifugal forces within the cap urge the storage area liquid or power contents from the storage area and into the container through keyways assembled in the seal.

DETAILED DESCRIPTION

The foregoing and other features and advantages of the threaded dispensing cap will be apparent from the following description of a particular embodiment, as illustrated in the accompanying drawings wherein like reference numbers generally indicate identical, functionally similar, and/or structurally similar elements. While specific exemplary embodiments are discussed, it should be understood that this is done for illustrative purposes only. A person skilled in the relevant art will recognize that other components and configurations can be used without departing from the scope of the subject matter as defined by the claims.

Figure 3:
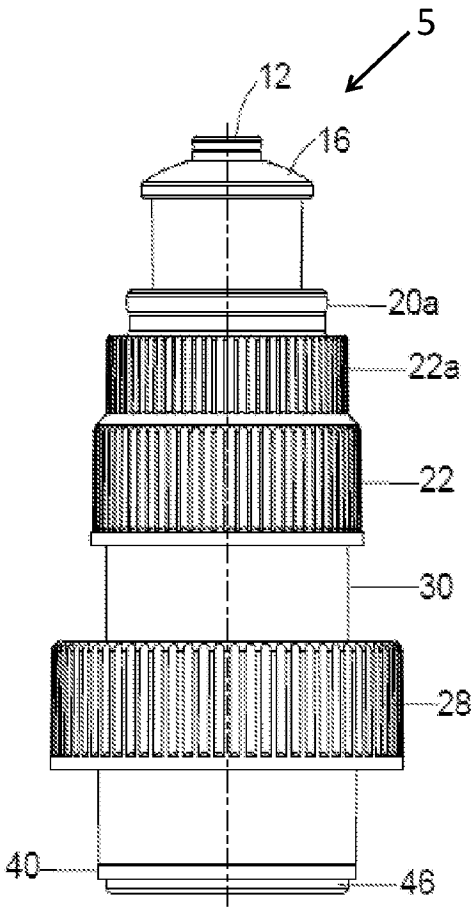
FIG. 3 depicts a side view of the cap in a closed and sealed position, according to the exemplary embodiment of FIG. 1.
Figure 1:
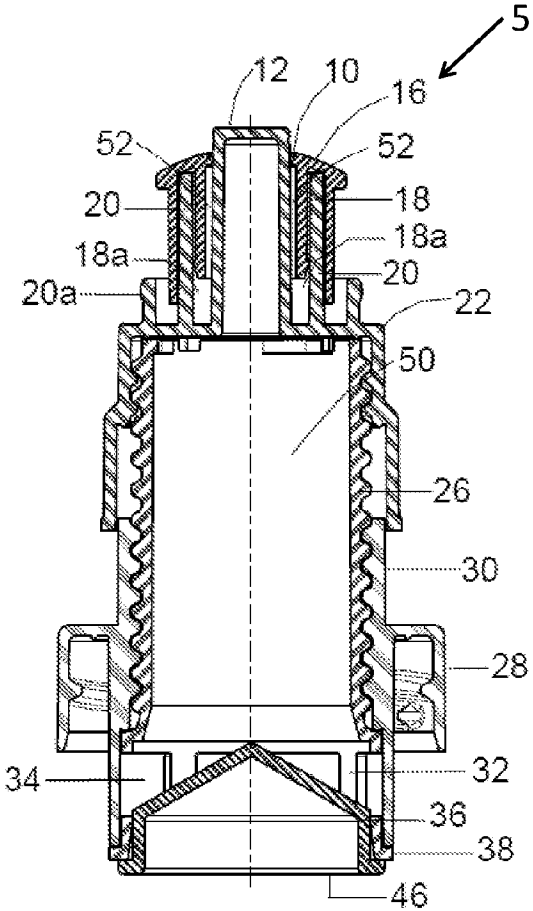
FIG. 1 depicts a sectional view of an exemplary embodiment of a cap in a closed and sealed position.

An embodiment of a cap is depicted with respect to FIGS. 1-9*c*. In FIG. 1, the dispensing caps are shown in a closed and sealed position. The dispensing caps are threaded and have a dispensing member 16 that is assembled in the top portion of the caps. The dispensing member 16 is a sipper or nozzle with a substantially cylindrical shape. The top of the dispensing member 16 forms a mushroom-shape that provides a user with a drinking sipper or nozzle that will not cause discomfort against the user's teeth or the tongue. The dispensing member 16 further includes an aperture 10 that provides a passage for a static plug 12 to pass through when the dispensing member 16 is in a lowered position, as shown in FIGS. 1 and 3. The static plug 12 is substantially cylindrical and remains in an upright position so as to prevent the flow or passage of the container and cap contents out of the dispensing member 16 when in the closed position. Centrally assembled within the cap and the dispensing member 16, the static plug 12 is surrounded by a flow channel. A portion 18 of the dispensing member 16 is assembled to keep the cap in a closed position by filling the spaces 18*a*, formed by the static plug 12 and a wall 20 arranged around the static plug 12, as shown in FIGS. 1 and 3. Further, in the closed position, as shown in FIG. 1, the bottom of the dispensing member 16 is arranged to fit inside of the space formed around the collar 20*a*.

In an alternative embodiment, the dispensing member takes the form a plurality of shapes or is opened using a plurality of opening means, such as a screwing, popping, snapping or snipping the top of the dispensing member or other non-limiting opening means. Additionally, in an alternative embodiment, the dispensing member 16 may be a sport-type tip or a solid non-functional closure configured with at least a 16 milliliter storage area but no more than a 19 milliliter storage area. In an alternative embodiment (not shown), depending on the type of liquid or powder contents inside of the storage area 50, the dispensing member 16 is provided with additional tamper protection. For example, a pressurized cover or cap can be placed on top of the cap to cover the dispensing member. The types of consumable liquid or powder contents inside of the storage area include, but are not limited to, nutritional supplements, drink flavors, and pharmaceutical contents.

In a further alternative embodiment, the dispensing caps may, but are not required to, include a removable position lock tamper band or break away tabs. The removable position lock tamper band or removable break away tabs can be arranged at various locations around the lower cylindrical collar 28, thereby providing additional protection from leakage of the storage area contents and movement of cap components. Once the removable position lock tamper band or removable break away tabs are removed, the upper cylindrical collar can be rotated to a downward position, thereby releasing the contents located within the storage area 50.

Figure 2:
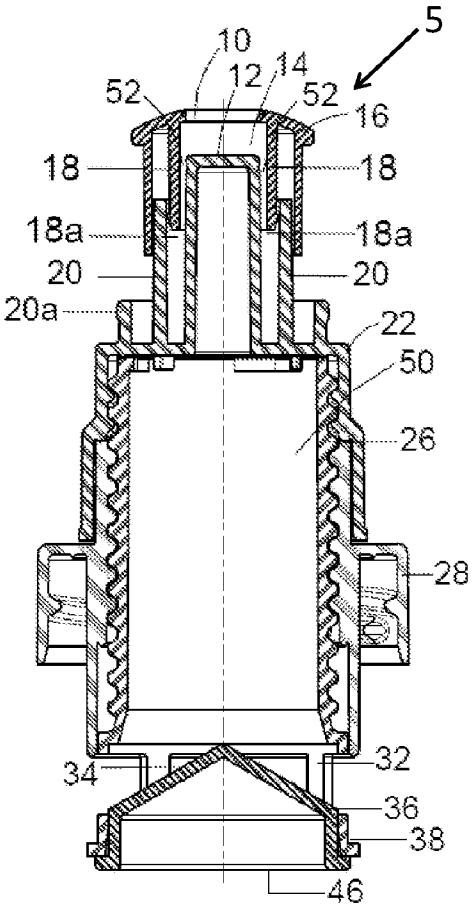
FIG. 2 depicts a sectional view of the cap in an open and unsealed position, according an exemplary embodiment.

In an embodiment, as shown in FIG. 2, the dispensing member 16 is pulled up to an open position. In the open position, a space 14 is created between the static plug 12 and the dispensing member 16 so that the contents of the container can pass through the storage area 50 and into the channel 52 located around the static plug 12. The cap is further configured so that the container contents located in the channel 52 flow into the dispensing member 16, and more specifically, fill the space 14. The cap is further assembled so that the contents inside of the space 14 exit through an aperture 10. When the cap is in a fully closed or sealed position, there is a substantial gap 30 between the bottom of the upper cylindrical collar 22 and the top of the lower cylindrical collar 28, as shown in FIGS. 1, 3, 4*b* and 4*c*. In order for the contents of the container to exit the dispensing member 16, the container must be rotated or tilted to a non-upright position to allow the contents to exit the dispensing member through openings in the bottom thereof. The maximum amount of contents dispensed from the cap is dependent upon the position of the container and cap. For example, when the container and cap are in an upside down, inverted, or a 180° position from its upright position, more contents are released than when the container and cap are positioned at an angle offset from the upside down or 180° position.

Further, the cap arrangement retains contents inside of the cap in the storage area 50, thereby keeping the cap contents separate from the container contents. The contents of the cap storage area 50 are kept separate from the contents inside of the container until the cap is manipulated to release the seal or end cap 36. Manipulation of the cap includes rotating the cap so that the outer threaded side wall 26 of the storage area 50 and the inner threaded side walls of the lower cylindrical collar 28 and upper cylindrical collar 22 engage one another. Still according to FIG. 2, this engagement of the cap's side wall rotates a portion of the cap downward so that the seal 36 separates from the bottom of the storage container 50 and the base of the upper cylindrical collar 22 is nearly flush with the top of the lower cylindrical collar 28. This downward rotation creates the centrifugal forces, in addition to gravity, that act upon the liquid, powder, or other material located within the dispensing cap storage area 50.

By rotating the upper cylindrical collar 22 in a clockwise direction, the storage area threads and the lower and upper cylindrical collar threads engage one another. In addition, by rotating the lower cylindrical collar 28 in a clockwise direction, the container outer threads (not shown) and the lower cylindrical collar 28 inner threads engage one another to close the top of the container. The cap is further configured so that rotating the upper cylindrical collar 22 clockwise to make contact with a lower cylindrical collar 28 releases the seal 36, as shown in FIG. 2. The clockwise threaded engagement of the upper cylindrical collar 22 inner threads and the storage area outer threads provide for a simple release of the seal 36. A clockwise rotation of the cap components both releases the seal 36 and allows the cap to firmly close around the top of a container. Further, the seal 36 is released to a maximum unsealed position when the upper cylindrical collar 22 can no longer be rotated downward to make closer contact with the lower cylindrical collar 28. By disengaging from the bottom of the cap, the seal 36 is arranged to provide openings or keyways 34 for the storage area 50 contents to pass through to the container. Attaching members or legs 32 are arranged to form the keyways 34 where the number of keyways 34 or dispensing end openings can vary. As shown in FIGS. 1, 2, 4*c*, and 7*c*, an L-shaped space 38 is provided on the seal 36 to ensure that the container remains sealed or locked when in the closed position. In an alternative embodiment (not shown), the seal may be a flat closure, thereby providing a basic flat cap closure for the storage area. In a further alternative embodiment, the seal may be configured of a shape and arranged to plug the bottom of the cap so that keyways and attaching members or legs are not needed to secure the seal or provide dispensing openings.

FIG. 3 depicts a side view of the cap, in a closed and sealed position, in which a textured or ribbed upper cylindrical collar 22, 22*a* and a ribbed lower cylindrical collar 28 are illustrated. The textured or ribbed collars provide gripping mechanisms for rotating the collars with respect to the container. The contents of the cap will not dispense when the dispensing member 16 is in the closed position shown in FIG. 3. When the seal 36 is released to allow the storage area 50 contents to release into the container, the mixture of the storage area 50 contents and the container contents will not dispense through the dispensing member 16, if the dispensing member 16 is still in the closed position shown in FIG.

3. However, the storage area 50 contents and the container contents can be mixed, prior to dispensing, without exposing the contents of either the storage area 50 or the container to ambient air.

Figure 4C:
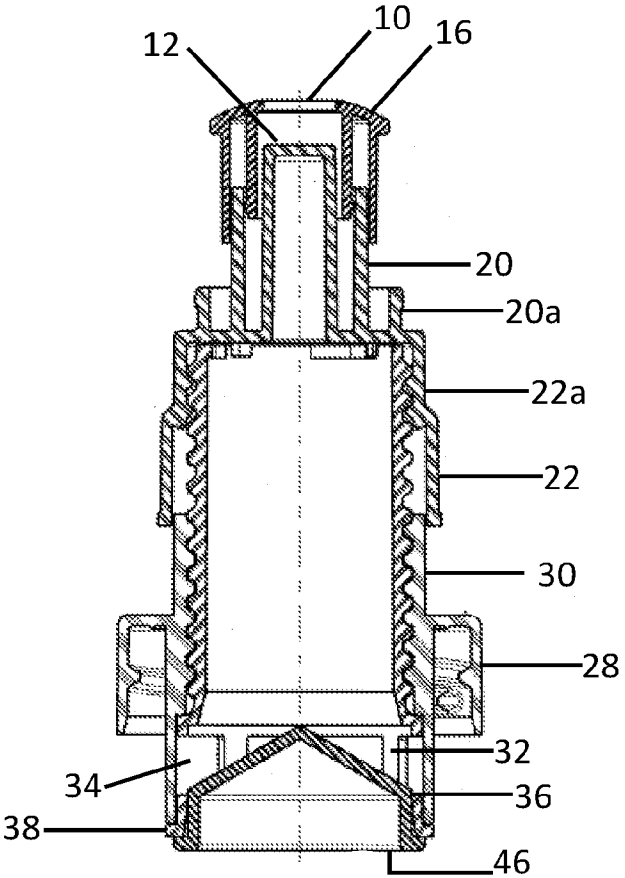
FIG. 4*c* depicts a sectional view of the cap in an open and sealed position, according to the exemplary embodiment of FIG. 4*b*.
Figure 4B:
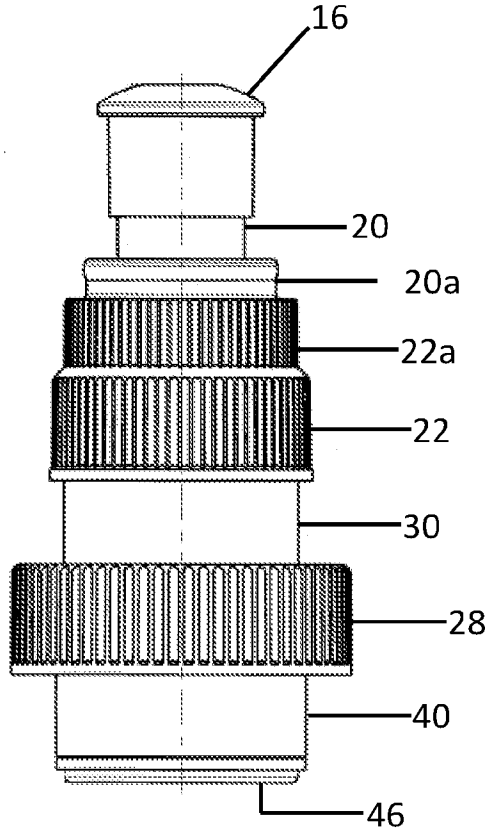
FIG. 4*b* depicts a side view of the cap in an open and sealed position, according to an exemplary embodiment.
Figure 4A:
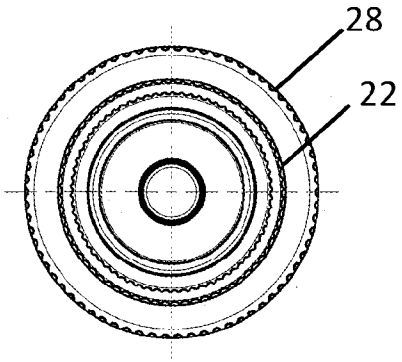
FIG. 4*a* depicts a top view of the cap, according to the exemplary embodiments of FIGS. 1-3.

FIG. 4*a* depicts a top view of the cap system, according to the exemplary embodiment of FIGS. 1-3, 4*b*, 4*c*. FIG. 4*a* shows a top view of the cap where the maximum cap diameter can be 1.48 to 1.68 inches. According to an embodiment, the maximum cap diameter is the diameter of the lower cylindrical collar 28. In an alternative embodiment, the maximum diameter of the cap is 1.58 inches.

FIGS. 4*b* and 4*c* depict a side view and cross-section of the cap when the storage area is sealed, but the dispensing member 16 is arranged in a raised position or an open position. In the sealed position where the dispensing member 16 is arranged in a raised or an open position, the height of the cap system can be 3.14 to 3.34 inches. In an alternative embodiment, the height of the cap system is 3.24 inches.

Figure 5C:
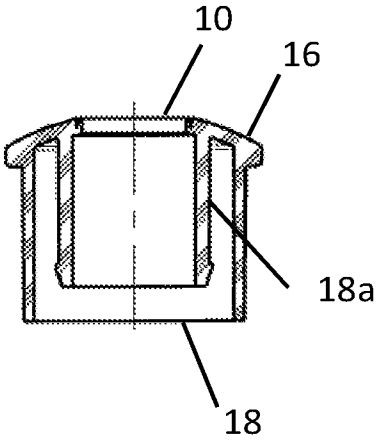
FIG. 5*c* depicts a sectional view of the dispensing member, according to the exemplary embodiments of FIGS. 5*a* and 5*b*.
Figure 5B:
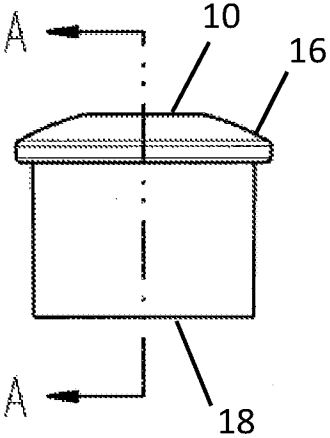
FIG. 5*b* depicts a side view of the dispensing member, according to the exemplary embodiment of FIG. 5*a*.
Figure 5A:
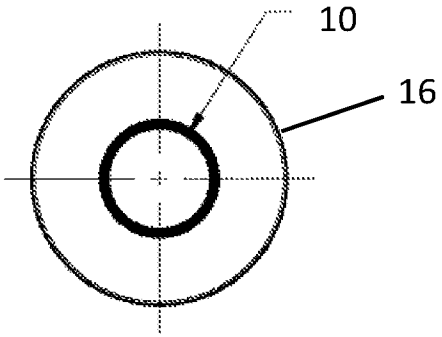
FIG. 5*a* depicts a top view of the dispensing member, according to an exemplary embodiment.

FIGS. 5*a*-5*c* depict an embodiment of the dispensing member 16 or the push/pull dispenser. When a user pulls the dispensing member 16 in an upward direction to the raised position, the dispensing member 16 locks into place in the open position. On the other hand, when a user pushes the dispensing member 16 in a downward direction, the dispensing member 16 locks into place in a closed position. As shown in FIGS. 5*a* and 5*b*, the dispensing member 16 is cylindrical or mushroom-shaped. In a non-limiting embodiment, the maximum diameter of the dispensing member 16 or the mushroom-shaped portion diameter can be 0.68 to 0.88 inches. In an alternative embodiment, the dispensing member 16 diameter is 0.78 inches. In a non-limiting embodiment, as shown in FIG. 5*c*, the diameter of the bottom 18 of the dispensing member 16 can be 0.57 to 0.77 inches. In an alternative embodiment, the diameter of the bottom 18 of the dispensing member 16 is 0.67 inches. Furthermore, the maximum height of the dispensing member 16, as shown in FIGS. 5*b* and 5*c*, can be 0.52 to 0.72 inches. In an alternative embodiment, the maximum height of the dispensing member 16 is 0.62 inches.

Figure 6A:
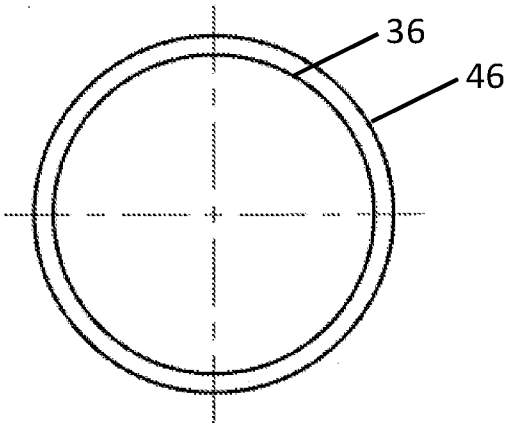
FIG. 6*a* depicts a top view of the storage area seal or end cap, according to an exemplary embodiment.
Figure 6B:
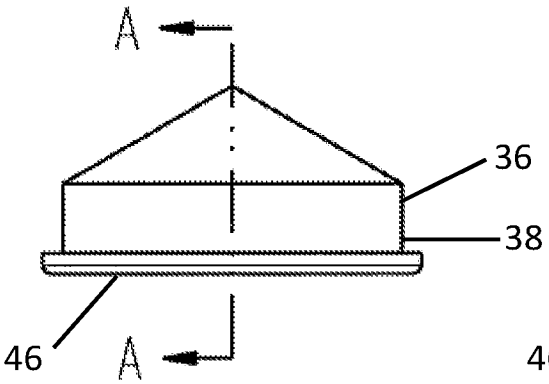
FIG. 6*b* depicts a side view of the storage area seal or end cap, according to the exemplary embodiment of FIG. 6*a*.
Figure 6C:
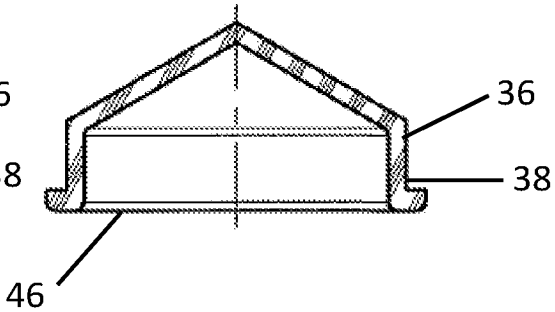
FIG. 6*c* depicts a sectional view of the storage area seal or end cap, according to the exemplary embodiments of FIGS. 6*a* and 6*b*.

According to an exemplary embodiment, as shown in FIGS. 6*a*-6*c*, the seal or container end cap 36, has a maximum diameter, or the diameter of the bottom 46 of the seal 36, can be 0.99 to 1.19 inches. The diameter of the portion of the seal 36 above the base 38, as shown in FIGS. 6*b* and 6*c*, can be 0.87 to 1.07 inches. In an alternative embodiment, the diameter of the portion of the seal 36 above the base 38 is 0.97 inches. In addition, the maximum total height of the seal 36, as shown in FIGS. 6*b* and 6*c*, can be 0.44 to 0.64 inches. In an alternative embodiment, the maximum total height of the seal 36 is 0.54 inches.

Figure 7C:
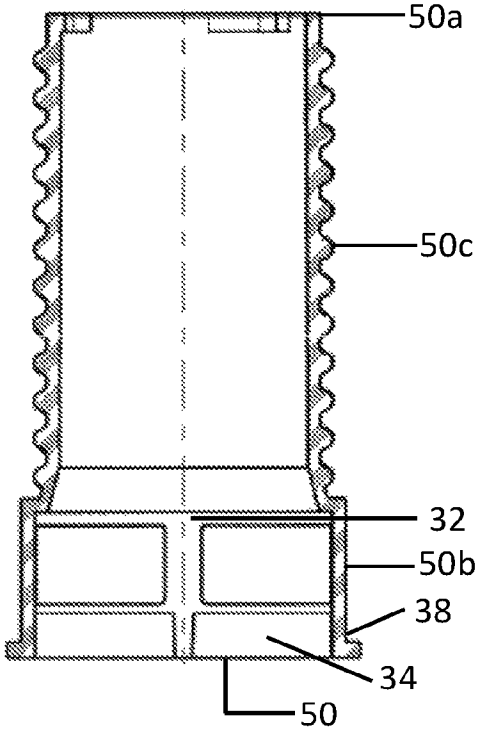
FIG. 7*c* depicts a sectional view of the storage area, according to the exemplary embodiments of FIGS. 7*a* and 7*b*.
Figure 7B:
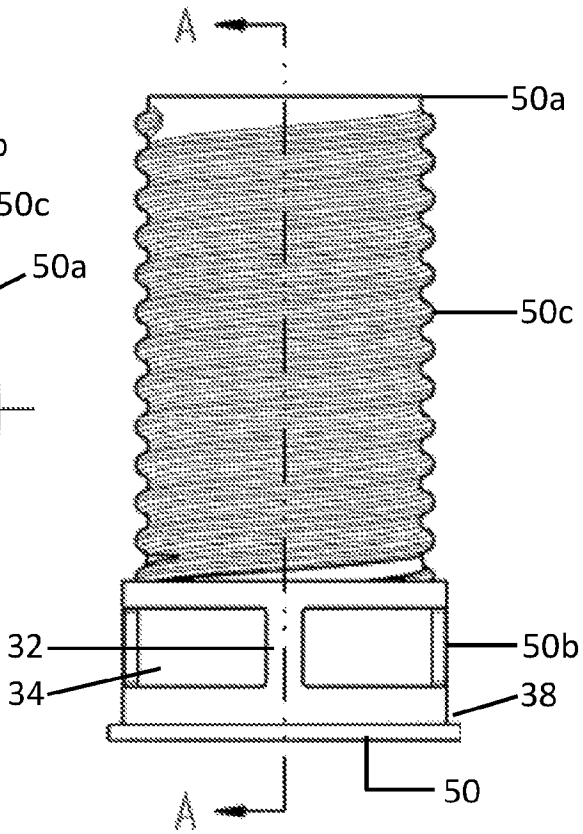
FIG. 7*b* depicts a side view of the storage area, according to the exemplary embodiment of FIG. 7*a*.
Figure 7A:
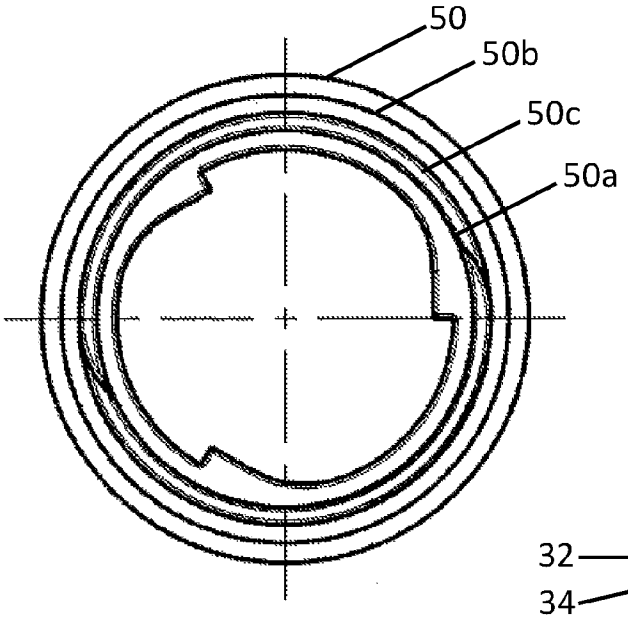
FIG. 7*a* depicts a top view of the storage area, according to an exemplary embodiment.

In an exemplary embodiment, FIGS. 7*a*-7*c* depict the storage area top, side, and sectional views, respectively. The maximum diameter of the storage area 50 or the diameter of the base of the storage area 50 can be 1.06 to 1.26 inches. In an alternative embodiment, the maximum diameter of the storage area 50 is 1.16 inches. According to an embodiment, the maximum height of the storage area 50 can be 2.03 to 2.23 inches. In an alternative embodiment, the maximum height of the storage area 50 is 2.13 inches. The diameter of the top portion 50*a* of the storage area 50, located above the threaded portion of the storage area, can be 0.79 to 0.99 inches. In alternative embodiment, the diameter of the top portion 50*a* of the storage area is 0.89 inches. The height of the base 50*b* portion of the storage area 50, located below the threaded portion of the storage area, can be 0.43 to 0.63 inches. In an alternative embodiment, the height of the base 50*b* portion of the storage area 50 is 0.53 inches. Further according to an embodiment, the base portion 50*b* of the storage area 50 has a larger diameter than the threaded portion 50*c* of the storage area, in order to provide a passage for adequate flow of the storage area contents, including keyways 34 and legs 32 for guiding the storage area contents out of the storage area and into the container. The L-shaped space 38 is provided on the storage area to receive the seal 36.

Figure 8C:
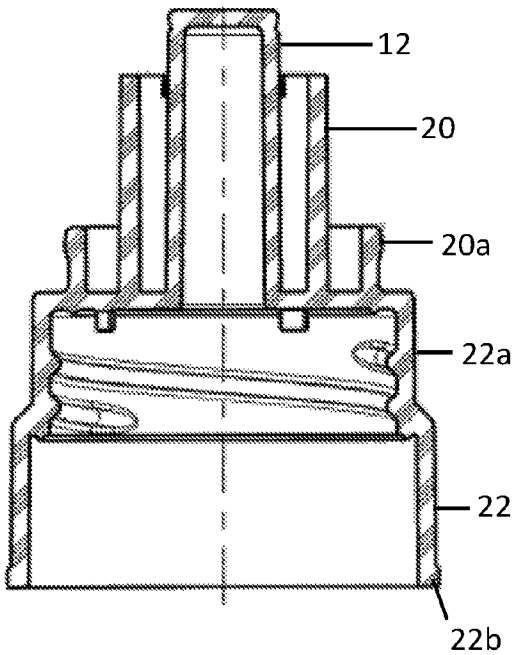
FIG. 8*c* depicts a sectional view of the static plug and the upper cylindrical collar, according to the exemplary embodiments of FIGS. 8*a* and 8*b*.
Figure 8B:
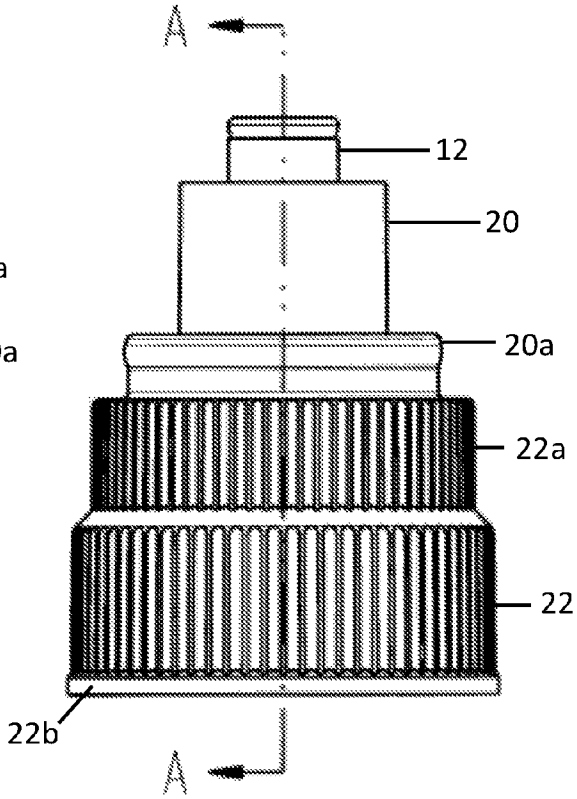
FIG. 8*b* depicts a side view of the static plug and the upper cylindrical collar, according to the exemplary embodiment of FIG. 8*a*.
Figure 8A:
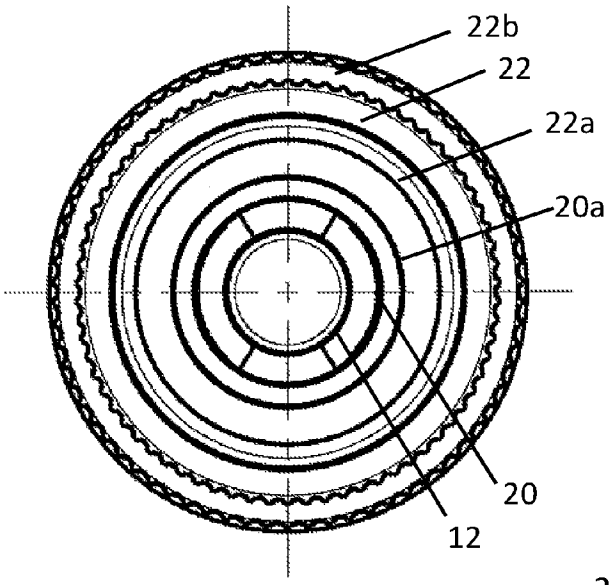
FIG. 8*a* depicts a top view of the upper cylindrical collar, according to an exemplary embodiment.

In an exemplary embodiment, FIGS. 8*a*-8*c* depict the upper cylindrical collar top, side, and sectional views, respectively. The exterior of the upper cylindrical collar 22*a*, 22 is substantially ribbed or textured to provide a gripping mechanism. Furthermore, the upper cylindrical collar includes the static plug 12 for guiding the dispensing member 16 and ensuring that the storage area 50 contents do not unintentionally flow out of the dispensing member 16. In an embodiment, the maximum diameter 22*b* of the upper cylindrical collar 22 can be 1.13 to 1.33 inches, and the diameter of the top portion 22*a* of the upper cylindrical collar 22 can be 0.98 to 1.18 inches. In an alternative embodiment, the maximum diameter 22*b* of the upper cylindrical collar 22 is 1.23 inches, and the diameter of the top portion 22*a* of the upper cylindrical collar 22 is 1.08 inches.

Further, in an embodiment, as shown in FIGS. 8*b* and 8*c*, the height of the ribbed or textured portion 22*a*, 22 of the upper cylindrical collar can be 0.74 to 0.94 inches, and the total height of the upper cylindrical collar or push/pull closure from above the static plug 12 to below the base of the collar 22*b*, as shown in FIG. 8*b*, can be 1.54 to 1.74 inches. In an alternative embodiment, the height of the ribbed or textured portion of the lower cylindrical collar is 0.84 inches, and the maximum height of the cylindrical collar or push/pull closure is 1.64 inches. The height from the base of the upper cylindrical collar to the top of the uppermost flange 20*a* can be 0.93 to 1.13 inches. In an alternative embodiment, 84 inches, and the maximum height of the cylindrical collar or push/pull closure is 1.64 inches, and in an alternative embodiment the height from the base of the upper cylindrical collar to the top of the uppermost flange 20*a* is 1.03 inches. As shown in FIGS. 8*b* and 8*c*, the height from the base of the upper cylindrical collar 22*b* to the top of the top of the wall 20 arranged around the static plug 12 can be 1.36 to 1.56 inches. In an alternative embodiment, the height from the base of the upper cylindrical collar 22*b* to the top of the top of the wall 20 arranged around the static plug 12 is 1.46 inches. In an embodiment, the diameter of the static plug 12 can be 0.21 to 0.41 inches, the diameter from the top of one wall 20 straight across to the opposite wall 20 can be 0.48 to 0.68 inches, and the diameter of the top of the uppermost flange 20*a* can be 0.8 to 1.0 inch. In an alternative embodiment, the diameter of the static plug 12 is 0.31 inches, the diameter from the top of one wall 20 straight across to the opposite wall 20 is 0.58 inches, and the diameter of the top of the uppermost flange 20*a* is 0.9 inches.

Further, in an alternative embodiment, the cap system can be disassembled by rotating the upper cylindrical collar in a counter clockwise direction, while the storage area maintains a sealed arrangement. The storage area can be filled with a liquid or power, and the cap system reassembled to threadedly engage the storage area and upper cylindrical collar.

Figure 9C:
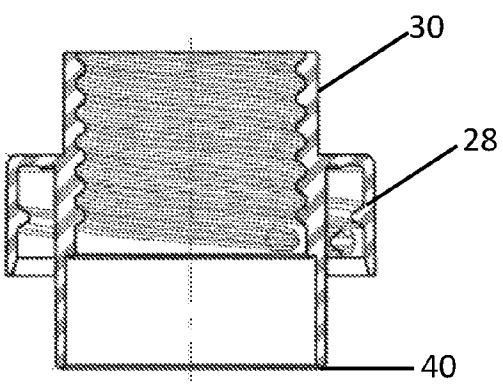
FIG. 9*c* depicts a sectional view of the lower cylindrical collar, according to the exemplary embodiments of FIGS. 9*a* and 9*b*.
Figure 9B:
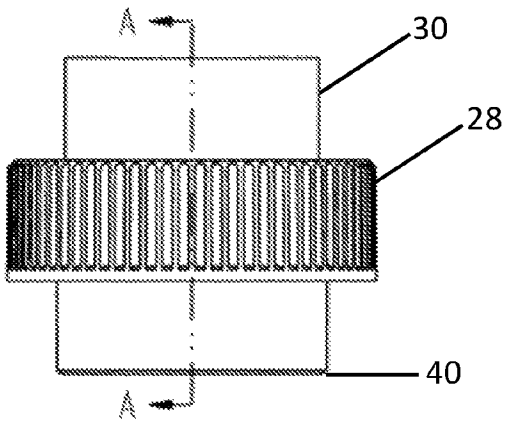
FIG. 9*b* depicts a side view of the lower cylindrical collar, according to the exemplary embodiment of FIG. 9*a*.
Figure 9A:
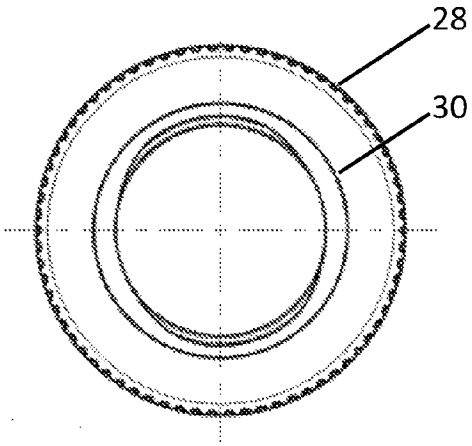
FIG. 9*a* depicts a top view of the lower cylindrical collar, according to an exemplary embodiment.

FIGS. 9*a*-9*c* depict a top view, a side view, and a sectional view of the lower cylindrical collar 28, respectively. The diameter of the lower cylindrical collar 28 can be 1.48 to 1.68 inches, and the height of the lower cylindrical collar 28 can be 0.42 to 0.62 inches. In an alternative embodiment, the diameter of the lower cylindrical collar 28 is 1.58 inches, and the height of the lower cylindrical collar 28 is 0.52 inches. The diameter of the cap bottle closure section 30, located above the lower cylindrical collar 28, can be 0.99 to 1.19 inches. In an alternative embodiment, the diameter of the cap bottle closure section 30 is 1.09 inches. The diameter of the cap bottle closure section 40, located below the lower cylindrical collar 28, can be 1.06 to 1.26 inches. In an alternative embodiment, the diameter of the cap bottle closure section 40 is 1.16 inches. The height from the top of the lower cylindrical collar 28 to the base of the bottle closure 40 can be 0.81 to 1.01 inches. In an alternative embodiment, the height from the top of the lower cylindrical collar 28 to the base of the bottle closure 40 is 0.91 inches. The total height of the bottle closure including the lower cylindrical collar, as shown in FIGS. 9*b* and 9*c*, can be 1.25 to 1.45 inches. In an alternative embodiment, the total height of the bottle closure is 1.35 inches.

A second embodiment of the dispensing cap 105 is depicted in FIGS. 10-17*c*. In the second embodiment, the dispensing member 116 is in the shape of an applicator or a nozzle. In an alternative embodiment, the dispensing member is configured as a universal dispensing cap for non-consumable applications including, but not limited to, skin care products, hair dye liquid, shampoo, conditioner, adhesives, coating, sealants, soaps, detergents, and fabric softeners. Further, in an alternative embodiment, the cap 105 is configured with a 70 milliliter storage area.

Figure 10:
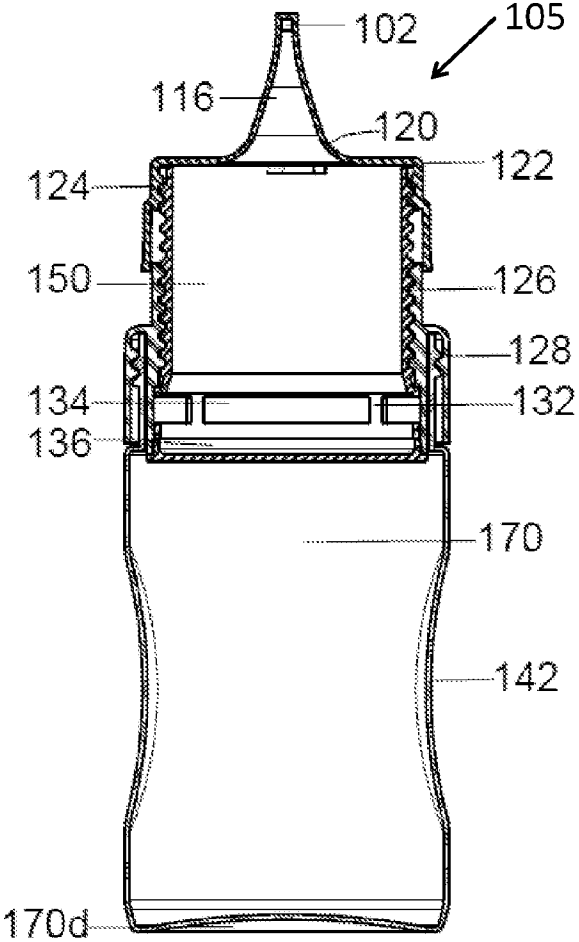
FIG. 10 depicts a sectional view of an exemplary embodiment of a cap and a container in a sealed position.

In FIG. 10, the cap 105 is shown in a closed or sealed position. A dispensing member cover 102 seals the cap arrangement until the cover 102 is removed. Removal of the cover 102 includes, but is not limited to, snapping, cutting, and pulling away from the dispensing member 116. Integrally formed within the top of the cap 105, the dispensing member 116 is in the shape of a nozzle or application with a widened base 120. The dispensing member arrangement provides for a streamlined flow of liquid or powder contents that are located within the container interior 170.

Figure 11:
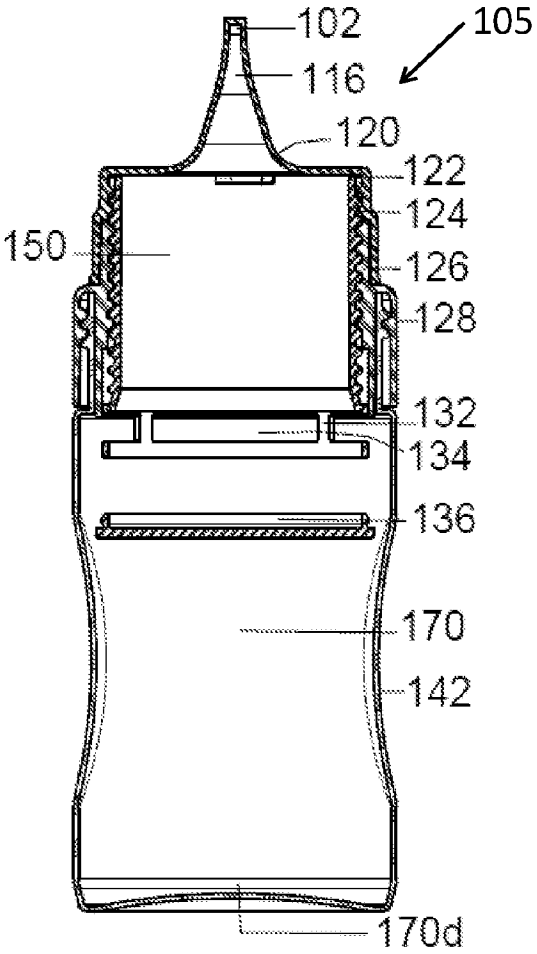
FIG. 11 depicts a sectional view of the exemplary embodiment of a cap and the container of FIG. 10 in an unsealed position.
Figure 12B:
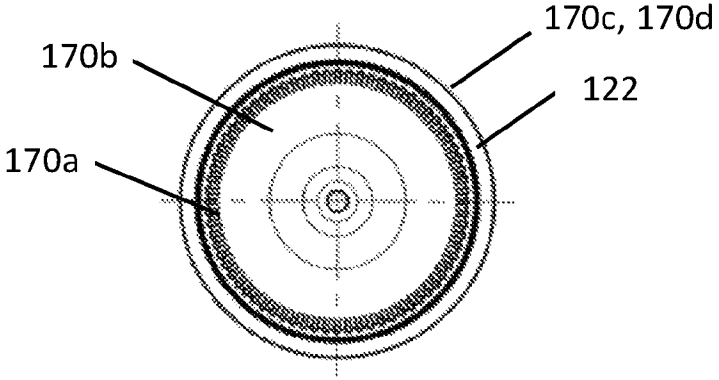
FIG. 12*b* depicts a top view of the cap and the container, according to the exemplary embodiment of FIGS. 10, 11, and 12.

In the second embodiment, the flow of contents dispensed outside of the container 170 is influenced by the configuration of the container side wall 142. As shown in FIGS. 10-12, an area of the container side wall 142 is inverted and at least partially compressible. These areas of the container provide an arrangement for squeezing the container so that the contents inside the container can undergo pressure. In an upside down, inverted, or 180° position from its upright position, the container contents dispense faster when the side wall areas 142 are squeezed or compressed.

As shown in FIGS. 10 and 11, the cap arrangement retains the storage area 150 contents inside of the cap and keeps the cap contents separate from the container contents. More specifically, the contents of the cap storage area 150 are kept separate from the contents inside of the container 170, until the cap is manipulated to release the seal 136. The cap storage area 150 can hold 70 milliliters of non-consumable liquids. In an alternative embodiment, the cap storage area 150 holds 19 milliliters of powder, including, but not limited to, hair dye powder. Further, manipulation of the cap includes rotating the cap so that the outer threaded side wall of the storage area 150 and the inner threaded side walls of the lower and upper cylindrical collars 128, 122 threadedly engage one another. This engagement and rotation of the cap's side walls 126 push the seal 136 downward so that the seal 136 completely separates from the bottom of the storage area 150 and falls into the container 170. A clockwise rotation of the cap components both releases the seal 136 and allows the cap to firmly close around the top of a container. The downward rotation of the cap creates the centrifugal forces, in addition to gravity, that act upon the liquid, powder, or other material located within the dispensing cap. Further, the viscosity of the contents located within the dispensing cap affect the centrifugal forces. For example, a more viscous material will experience higher centrifugal forces than a less viscous material.

The upper cylindrical collar 122 includes internal cylindrical collar threads 124 for rotating the collar about the top of the storage area 150. By rotating the upper cylindrical collar 122 in a clockwise direction, the storage area 150 and the cylindrical collars 122, 128 engage one another. The cap is further configured so that rotating the upper cylindrical collar 122 clockwise to make contact with a lower cylindrical collar 128 releases the seal 136. By disengaging the seal 136 from the bottom of the cap, the storage area 150 is arranged with keyways 134 or dispensing end openings to pass contents through the keyways 134 and into the container 170. Attaching members or legs 132 are arranged to form the keyways 134 where the number of keyways 134 or dispensing end openings can vary. As shown in FIGS. 10, 11, and 13*b*, the seal 136 is flat and provides a basic dispensing end sealing mechanism. In an alternative embodiment, the seal is a conical or pyramidal cap, thereby providing a dome-shaped cap closure for a storage area.

As shown in FIG. 11, the upper cylindrical collar 122 is arranged to rotate in a downward direction to a lowered position, thereby releasing the contents located within the storage area 150. The seal 136 is released to a maximum unsealed position, causing the seal 136 to completely disengage from the storage area 150 and into the container 170, when the upper cylindrical collar 122 is rotated downward to make contact with the lower cylindrical collar 128. As previously discussed, this downward rotation creates the centrifugal forces, in addition to gravity, that act upon the liquid, powder, or other material located within the dispensing cap. Further, the viscosity of the contents located within the dispensing cap affect the centrifugal forces. For example, a more viscous material will experience higher centrifugal forces than a less viscous material.

Figure 12A:
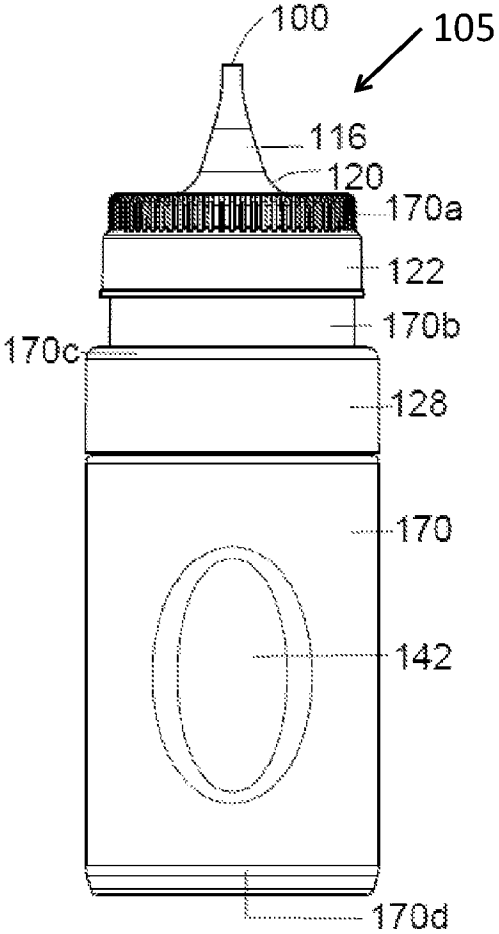
FIG. 12*a* depicts a side view of the cap and the container in the sealed position, according to the exemplary embodiment of FIG. 10.

In FIG. 12, a side view of the cap is depicted, in which at least a portion 170*a* of the upper cylindrical collar 122 is textured or ribbed. Furthermore, the inverted side wall area 142 can, but is not required, to provide a reduced thickness cylindrical wall. FIG. 12*a* depicts a top view of the cap and bottle. The maximum cap and bottle system diameter can be 2.15 to 2.35 inches. In an alternative embodiment, the maximum cap and bottle system diameter is 2.25 inches. The maximum height of the cap and bottle system or the height of the cap and bottle in a sealed position can be 6.27 to 6.47 inches. In an alternative embodiment, the maximum height of the cap and bottle system is 6.37 inches. When arranged in an unsealed position, as shown in FIG. 11, the height of the cap and bottle system is less than 6.37 inches or less than the height of the cap and bottle system in the sealed position.

Further, in an alternative embodiment, the cap system is disassembled by rotating the upper cylindrical collar in a counter clockwise direction, while the storage area maintains a sealed arrangement. The storage area is filled with a liquid or power, and the cap system reassembled to threadedly engage the storage area and upper cylindrical collar.

Additionally, in an alternative embodiment, the storage area is configured of a desired height and has a width resembling the shape of a funnel above the bottle (not shown). This shape of the storage area and its width provides the ability to increase the storage capacity, in the cap portion above the storage area.

Figure 13C:
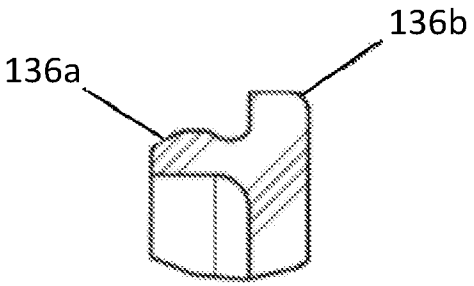
FIG. 13*c* depicts a detailed view of an end of the storage area seal or end cap, according to the exemplary embodiment of FIG. 13*b*.
Figure 13B:
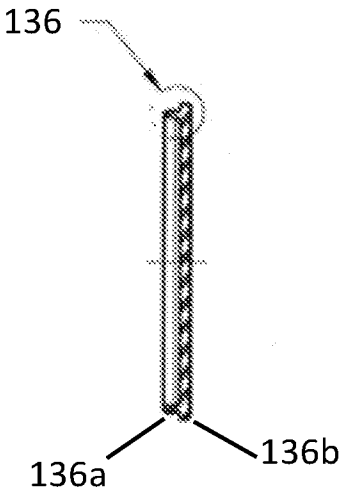
FIG. 13*b* depicts a side view of the storage area seal or end cap, according to the exemplary embodiment of FIG. 13*a*.
Figure 13A:
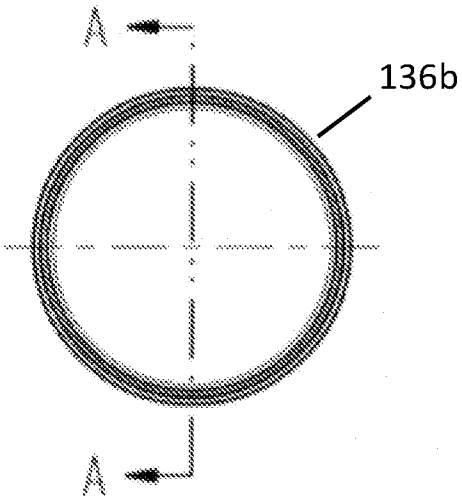
FIG. 13*a* depicts a top view of the storage area seal or end cap, according to an exemplary embodiment.

FIGS. 13*a*-13*c* depict a top view, a side view, and a sectional view of the seal or container end cap 136, respectively. The maximum diameter of the seal 136 can be 1.84 to 2.04 inches and the diameter of the seal lip 136*a* can be 1.76 to 1.96 inches. In an alternative embodiment, the maximum diameter of the seal 136 is 1.94 inches and the diameter of the seal lip 136*a* is 1.86 inches The seal lip 136*a* is configured to fit inside of the lower cylindrical collar 128 or the base of the bottle closure inner diameter 128*a*. Further, as shown in FIG. 13*c*, the total thickness of the seal or container end cap 136 can be 0.06 to 0.26 inches and the thickness of the seal flange 136*b* can be 0.04 to 0.08 inches. In an alternative embodiment, the total thickness of the seal or container end cap 136 is 0.16 inches and the thickness of the seal flange 136*b* is 0.06 inches.

Figure 14C:
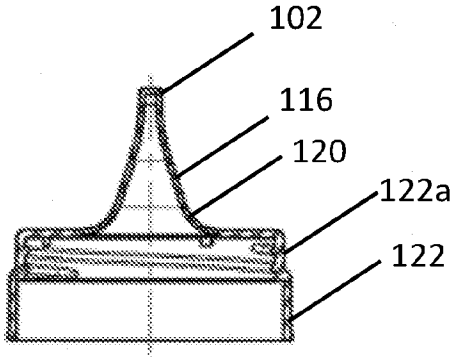
FIG. 14*c* depicts a sectional view of the upper cylindrical collar, according to the exemplary embodiments of FIGS. 14*a* and 14*b*.
Figure 14B:
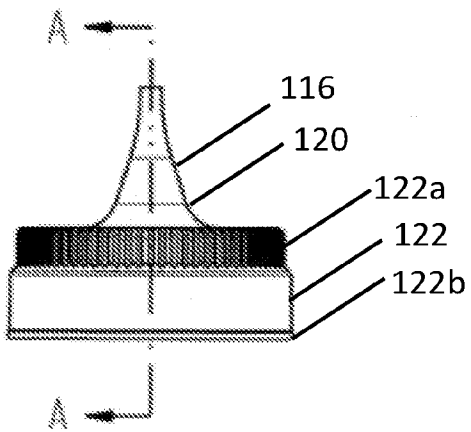
FIG. 14*b* depicts a side view of the upper cylindrical collar, according to the exemplary embodiment of FIG. 14*a*.
Figure 14A:
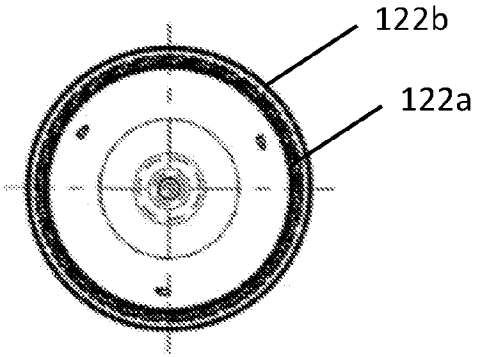
FIG. 14*a* depicts a top view of the upper cylindrical collar, according to an exemplary embodiment.

FIGS. 14*a*-14*c* depict a top view, a side view, and a sectional view, respectively, of the cap upper cylindrical collar 122 and the dispensing member 116. The maximum diameter of the upper cylindrical collar 122*b* can be 1.91 to 2.11 inches. In an alternative embodiment, the maximum diameter of the upper cylindrical collar 122*b* is 2.01 inches. The diameter of the top or ribbed portion 122*a* of the upper cylindrical collar can be 1.78 to 1.98 inches. In an alternative embodiment, the diameter of the top or ribbed portion 122*a* of the upper cylindrical collar is 1.88 inches. The height of the upper cylindrical collar 122 including the dispensing member 16 can be 1.69 to 1.89 inches. In an alternative embodiment, the height of the upper cylindrical collar 122 including the dispensing member 16 is 1.79 inches. The height of the upper cylindrical 122 collar including the top or ribbed portion 122*a* can be 0.69 to 0.89 inches. In an alternative embodiment, the height of the upper cylindrical 122 collar including the top or ribbed portion 122*a* is 0.79 inches. Further, in an alternative embodiment (not shown), the upper cylindrical collar completely separates from the lower cylindrical collar and storage area. As such, the storage area can be filled and/or emptied with desired contents by simply rotating the upper cylindrical collar in a counterclockwise direction with respect to the lower cylindrical collar.

Figure 15C:
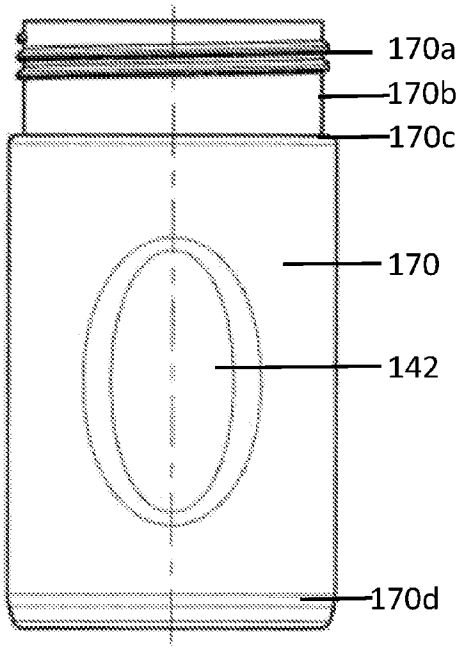
FIG. 15*c* depicts a side view of the bottle, according to the exemplary embodiments of FIGS. 15*a* and 15*b*.
Figure 15B:
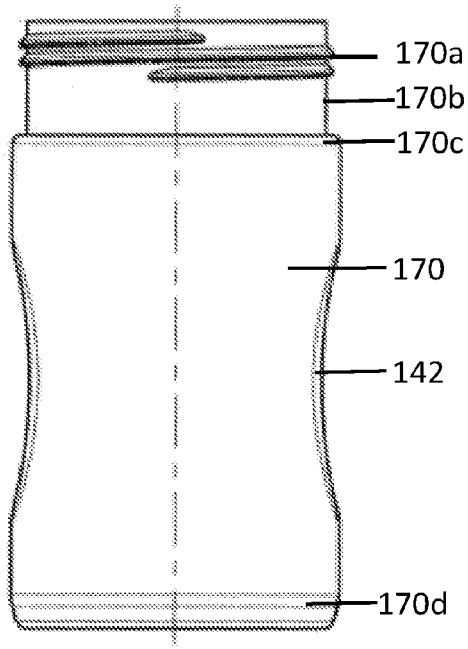
FIG. 15*b* depicts a side view of the bottle, according to the exemplary embodiment of FIG. 15*a*.
Figure 15A:
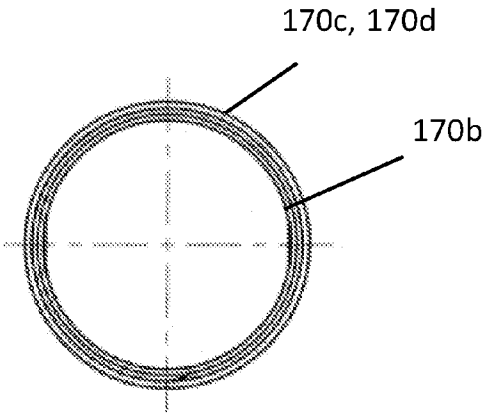
FIG. 15*a* depicts a top view of the bottle, according to an exemplary embodiment.

FIGS. 15*a* and 15*b* depict side views of the bottle 170 including the threaded bottle top portion 170*a*. Below the ribbed or textured portion of the bottle 170*a* is a smooth cylindrical section 170*b*. In an alternative embodiment (not shown), a portion or all of the lower and/or upper cylindrical collars are textured or smooth. In an embodiment, the height of the top of the bottle including the threaded portion 170*a* and the smooth portion 170*b* can be 0.67 to 0.87 inches. In an alternative embodiment, the height of the top of the bottle including the threaded portion 170*a* and the smooth portion 170*b* is 0.77 inches. FIG. 15*c* depicts a top view of the bottle including a maximum diameter 170*c*, 170*d* of 2.15 to 2.35 inches. In an alternative embodiment, the maximum diameter of the bottle is 2.25 inches. The diameter of the top portion 170*b* of the bottle can be 1.95 to 2.15 inches. In an alternative embodiment, the diameter of the top portion of the bottle is 2.05 inches. The maximum total height of the bottle 170 including the top portion 170*b* and threaded portion 170*a* (without the cap) can be 4.05 to 4.25 inches. In an alternative embodiment, the total height of the bottle is 4.15 inches. The height of the bottle excluding the top portion 170*b* and threaded portion 170*a* can be 3.28 to 3.48 inches. In an alternative embodiment, the height of the bottle excluding the top portion 170*b* and threaded portion 170*a* is 3.38 inches.

Figure 16C:
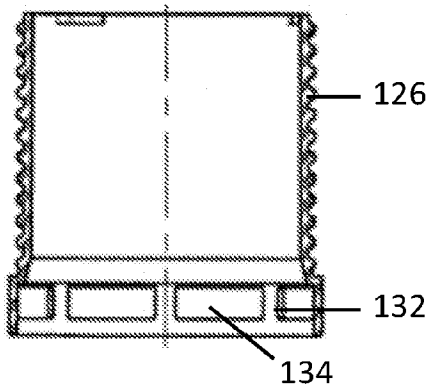
FIG. 16*c* depicts a sectional view of the storage area, according to the exemplary embodiments of FIGS. 16*a* and 16*b*.
Figure 16B:
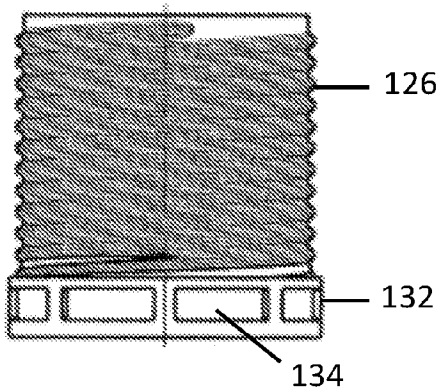
FIG. 16*b* depicts a side view of the storage area, according to the exemplary embodiment of FIG. 16*a*.
Figure 16A:
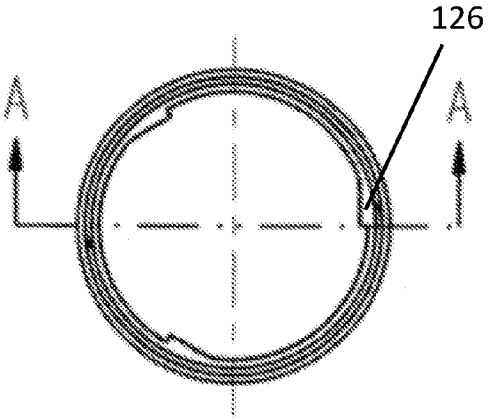
FIG. 16*a* depicts a top view of the storage area, according to an exemplary embodiment.

FIGS. 16*a*-16*c* depict a top view, a side view, and sectional view of the threaded storage area, respectively. The storage area 126 is configured to hold a number of products including, but not limited to, hair dye, powders, and liquids. The height of the storage area 126, as shown in FIGS. 16*b* and 16*c*, can be 1.79 to 1.99 inches, and the height of the base of the storage area including legs 132 and keyways 134 can be 0.25 to 0.45 inches. In an alternative embodiment, the height of the storage area 126 is 1.89 inches, and the height of the base of the storage area including legs 132 and keyways 134 is 0.35 inches. The maximum diameter of the base of the storage area 126, as shown in FIGS. 16*a*-16*c*, can be 1.75 to 1.95 inches and the diameter of the top of the storage area 126 can be 1.58 to 1.78 inches. In an alternative embodiment, the maximum diameter of the base of the storage area 126 is 1.85 inches and the diameter of the top of the storage area 126 is 1.68 inches.

Figure 17C:
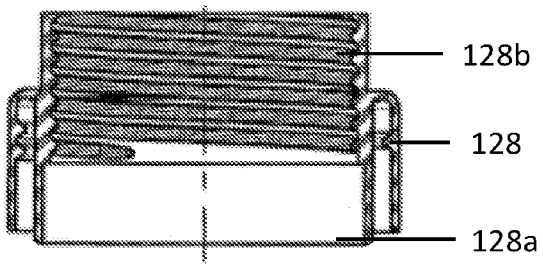
FIG. 17*c* depicts a sectional view of the cap lower cylindrical collar, according to the exemplary embodiments of FIGS. 17*a* and 17*b*.
Figure 17B:
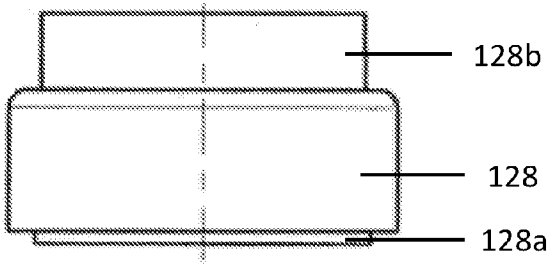
FIG. 17*b* depicts a side view of the cap lower cylindrical collar, according to the exemplary embodiment of FIG. 17*a*.
Figure 17A:
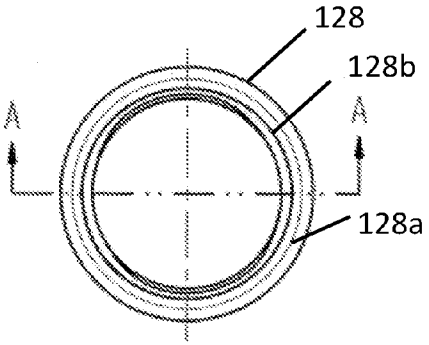
FIG. 17*a* depicts a top view of the cap lower cylindrical collar, according to an exemplary embodiment.

FIGS. 17*a*-17*c* depict a top view, a side view, and a sectional view of the lower cylindrical collar or bottle closure 128, respectively. As shown in FIGS. 17*a*-17*c*, the smallest diameter of the lower cylindrical collar or the diameter of the top of the bottle closure 128*b* can be 1.77 to 1.97 inches. In an alternative embodiment, the smallest diameter of the lower cylindrical collar or the diameter of the top of the bottle closure 128*b* is 1.87 inches. Further, the top of the lower cylindrical collar or the top of the bottle closure 128*b* is arranged to fit inside of the upper cylindrical collar 122 and has a height of 0.33 to 0.53 inches. In an alternative embodiment, the top of the lower cylindrical collar 128*b* has a height of 0.43 inches. This portion 128*b* of the bottle closure is exposed when the cap is in the sealed position and is no longer exposed but covered by the upper cylindrical collar 122 when the cap is unsealed.

Still according to FIGS. 17*a*-17*c*, the maximum diameter of the lower cylindrical collar 128 can be 2.15 to 2.35 inches. In an alternative embodiment, the maximum diameter of the lower cylindrical collar 128 is 2.25 inches. Further, the height of the lower cylindrical collar 128 can be 0.71 to 0.91 inches. In an alternative embodiment, the height of the lower cylindrical collar 128 is 0.81 inches. The height of the lower cylindrical collar 128 including the base portion 128*a* can be 0.79 to 0.99 inches. In an alternative embodiment, the height of the lower cylindrical collar 128 including the base portion 128*a* is 0.89 inches. The height of the lower cylindrical collar or bottle closure 128 including the base portion 128*a* and the top portion 128*b* can be 1.22 to 1.42 inches. In an alternative embodiment, the height of the lower cylindrical collar or bottle closure 128 including the base portion 128*a* and the top portion 128*b* is 1.32 inches. The bottle closure inner diameter 128*a* can be 1.84 to 2.04 inches or nearly 95% of the diameter of the seal lip 136*a*. In an alternative embodiment, the bottle closure inner diameter 128*a* is 1.94 inches.

A third embodiment of the dispensing cap 205 is depicted in FIGS. 18-26*b*. In the third embodiment, as shown in FIGS. 18-20 and 21*b*-21*c*, the dispensing member 216 is in the shape of a nipple with a wide-base or a dome-shaped body and configured to be filled with liquid and reduce air intake when in-use. The base 210 of the nipple 216 is arranged inside of an inward flange 212 of the cap for securing the dispensing member 216 using the dispensing member annular recess 220.

Figure 18:
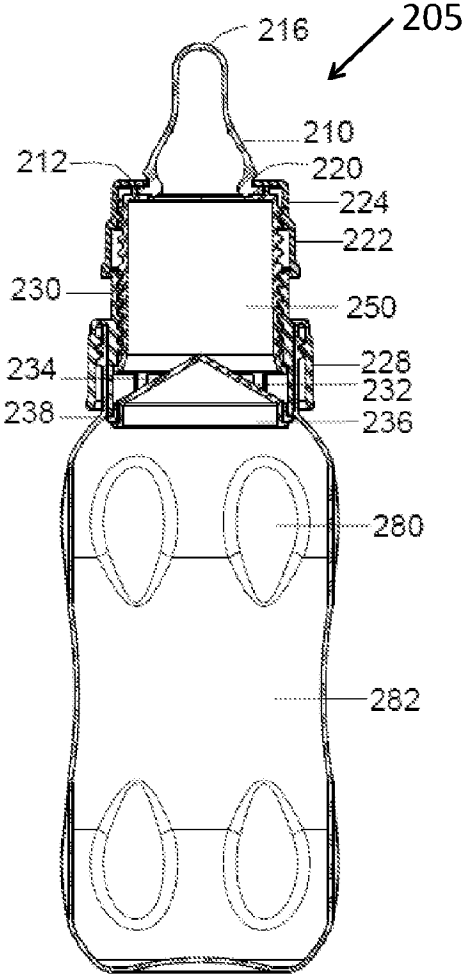
FIG. 18 depicts a sectional view of a cap and a bottle in a sealed position, according to a further exemplary embodiment.
Figure 26B:
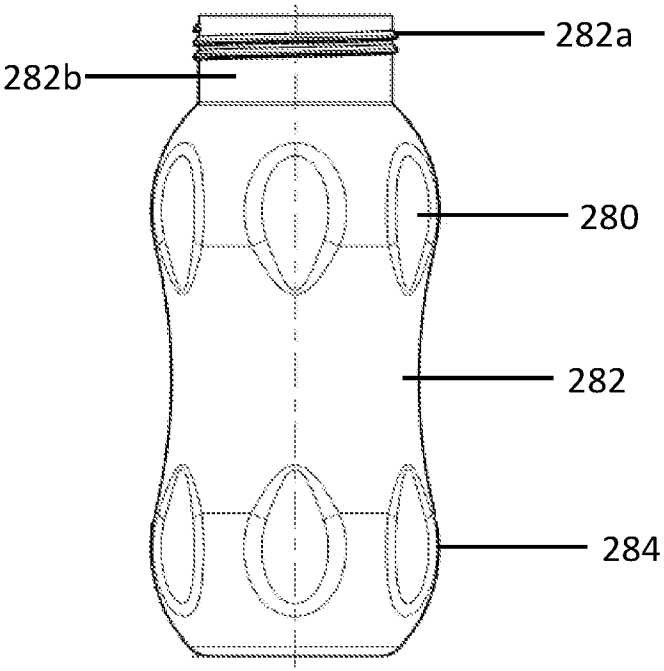
FIG. 26*b* depicts a side view of the bottle without a cap, according to the exemplary embodiment of FIG. 26*a*.

In FIG. 18, the dispensing cap 205 is shown in a closed position. At least one inverted or depressed area 280 of the container is arranged to provide gripping mechanisms. In addition, the depressed area 280 can be configured as a thinner cylindrical wall to provide an area for squeezing or compressing the container, as shown in FIGS. 18 and 26*b*. The container and cap are configured to provide a faster flow of contents when the container is squeezed in an upside down, inverted, or 180° position from the container and cap system's upright position. According to this embodiment, the cap holds, for example, at least two scoops or 40 milliliters of baby formula powder for travel convenience, nighttime feedings, and use of the cap by grandparents, caregivers and daycare centers. In order to maintain the integrity of the cap, prior to use, the dispensing member and the cap contents are wrapped in a blister pack or similar packaging.

As shown in FIG. 18, the cap arrangement retains the contents inside of the cap 205 and keeps the cap contents separate from the container 282 contents. More specifically, the contents of the cap storage area 250 are kept separate from the contents inside of the container 282, until the cap is manipulated to release the seal 236. In the closed position, a smooth recessed cylindrical section 230, as shown in FIG. 18, is arranged between the upper cylindrical collar 222 and the lower cylindrical collar 228. Manipulation of the cap includes rotating the cap in a clockwise direction so that the outer threaded side wall of the storage area 250 threadedly engages both the inner threaded side wall of the lower cylindrical collar 228 and the inner threaded side wall of the upper cylindrical collar 222. A clockwise rotation of the cap components both releases the seal 136 and allows the cap to firmly close around the top of a container. The upper cylindrical collar 222 includes a cylindrical portion 224 that has a smaller diameter than the textured portion of the collar 222. Rotation of the cap's threaded collars and the threaded storage area push the seal 236 downward so that the seal 236 separates from the bottom of the storage area 250. The cap is further configured so that rotating the upper cylindrical collar 222 clockwise allows the upper collar to make contact with a lower cylindrical collar 228. This downward rotation creates centrifugal forces, in addition to gravity, that act upon the liquid, powder, or other material arranged inside of the storage area 250. Further, the viscosity of the contents located within the storage area 250 affect the centrifugal forces. For example, a more viscous material will experience higher centrifugal forces than a less viscous material.

Figure 25C:
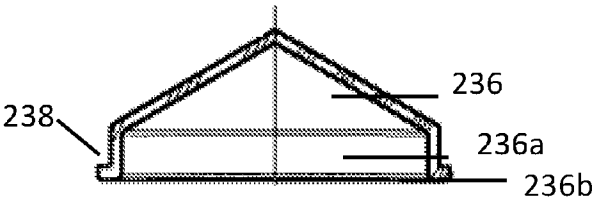
FIG. 25*c* depicts a sectional view of an end of the storage area seal or end cap, according to the exemplary embodiment of FIG. 25*a*.
Figure 25B:
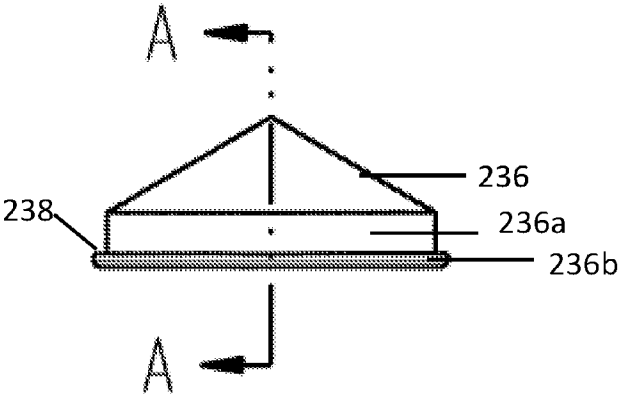
FIG. 25*b* depicts a side view of the storage area seal or end cap, according to the exemplary embodiments of FIGS. 25*a* and 25*b*.

By disengaging the seal 236 from the bottom of the cap, the seal 236 is arranged to provide keyways 234 for the storage area 250 contents to pass through to the container. Attaching members or legs 232 are arranged to form any desired number of keyways 234 or dispensing end openings. As shown in FIGS. 25*b* and 25*c*, further provided on opposite sides of the seal 236 is an L-shaped space 238 to ensure that the container remains sealed or locked when in the closed position. In an embodiment, the seal 236 is a flat non-dispensing seal (not shown), thereby providing a basic flat cap closure for the storage area 250.

Figure 19:
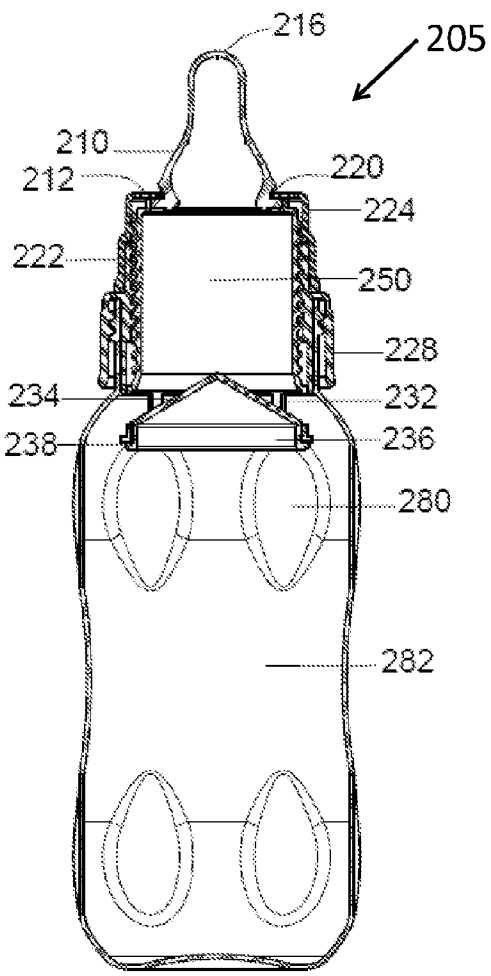
FIG. 19 depicts a sectional view of the cap and the bottle in an unsealed position, according to the exemplary embodiment of FIG. 18.

In FIG. 19, the third embodiment is shown in an open position. As shown in FIG. 19, the upper cylindrical collar 222 is rotated to a downward position, thereby releasing the contents located within the storage area 250. The seal 236 is released to a maximum unsealed position when the upper cylindrical collar 222 is rotated downward to make contact with the lower cylindrical collar 228. As previously discussed, this downward rotation creates centrifugal forces, in addition to gravity, that act upon the liquid, powder, or other material located within the storage area 250.

Figure 20B:
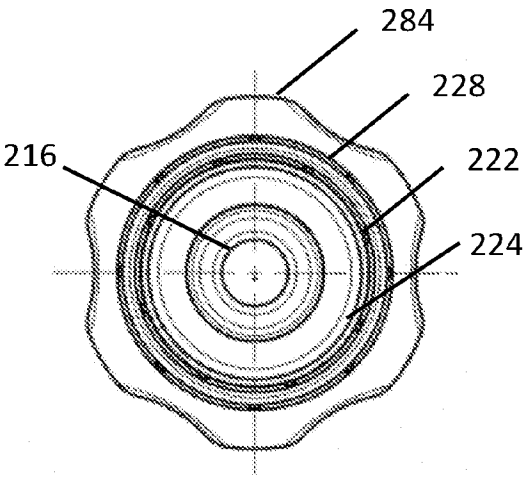
FIG. 20*b* depicts a top view of the cap and the bottle, according to the exemplary embodiments of FIGS. 18-20*b*.
Figure 20A:
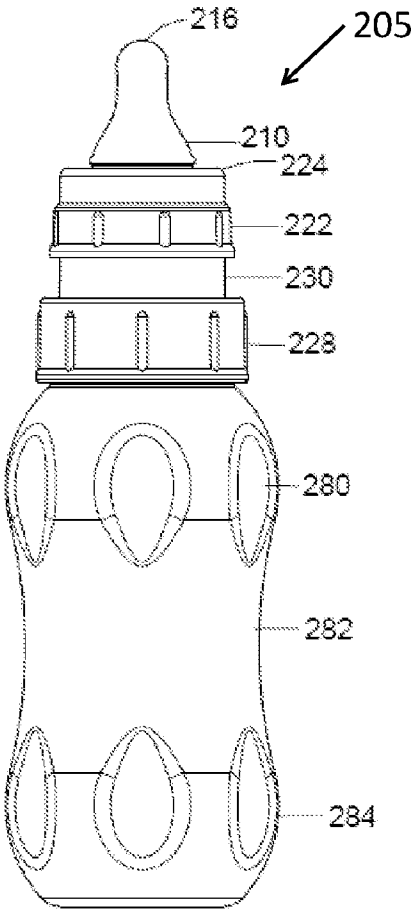
FIG. 20*a* depicts a side view of the cap and the bottle in a sealed position, according to the exemplary embodiment of FIG. 18.

In FIG. 20*a*, a side view of the cap is depicted in which at least a portion of the upper cylindrical collar 222 is textured or ribbed. As shown in FIGS. 18-20*b*, inverted side wall area 280 can, but is not required, to provide a reduced thickness cylindrical wall. FIG. 20*a* depicts a top view of the cap and bottle assembly including a maximum diameter of 2.53 to 2.73 inches or the diameter of the base of the bottle 284. In an alternative embodiment, the maximum diameter of the cap and bottle assembly is 2.63 inches. The diameter of the top of the bottle 282*b* can be 1.66 to 1.86 inches. In an alternative embodiment, the diameter of the top of the bottle 282*b* is 1.76 inches.

Figure 21C:
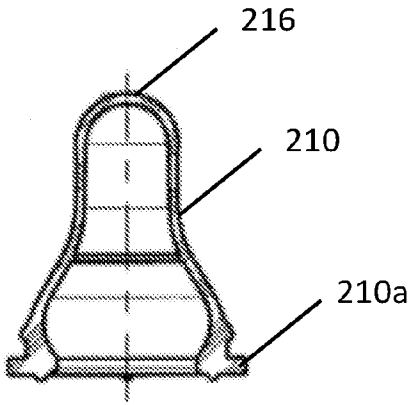
FIG. 21*c* depicts a sectional view of the dispensing member or nipple, according to the exemplary embodiment of FIG. 21*a*.
Figure 21B:
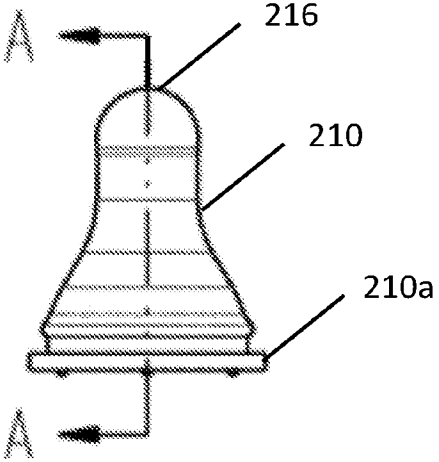
FIG. 21*b* depicts a side view of the dispensing member or nipple, according to the exemplary embodiments of FIGS. 21*a* and 21*b*.
Figure 21A:
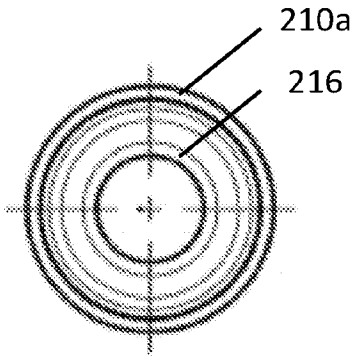
FIG. 21*a* depicts a top view of the dispensing member or nipple, according to an exemplary embodiment.

FIGS. 21*a*-21*c* depict a top view, a side view, and a sectional view, respectively, of the dispensing member or nipple 216. The dispensing member or nipple 216 has a base 210*a* with a maximum diameter of 1.04 to 1.24 inches. In an alternative embodiment, the diameter of the base 210*a* is 1.14 inches. Further, the height of the nipple 216 from below the base 210*a* to the uppermost point can be 1.26 to 1.46 inches. In an alternative embodiment, the height of the nipple 216 is 1.36 inches.

Figure 22C:
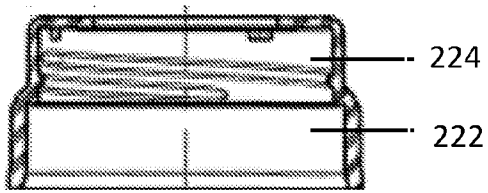
FIG. 22*c* depicts a sectional view of the upper cylindrical collar or nipple ring, according to the exemplary embodiments of FIGS. 22*a* and 22*b*.
Figure 22B:
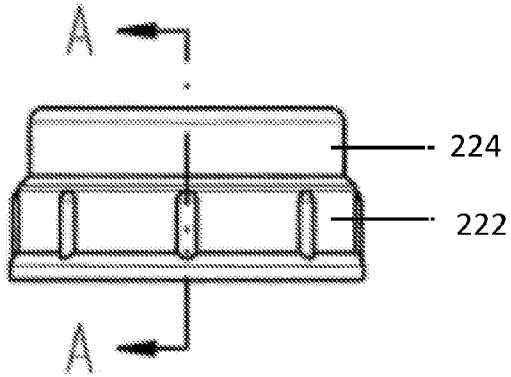
FIG. 22*b* depicts a side view of the upper cylindrical collar or nipple ring, according to the exemplary embodiment of FIG. 22*a*.
Figure 22A:
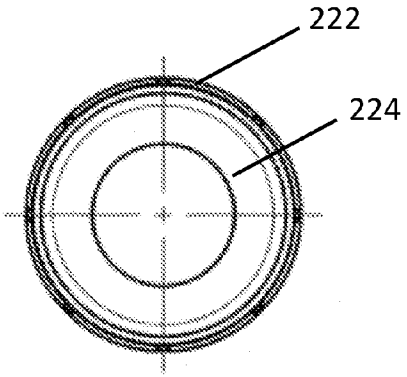
FIG. 22*a* depicts a top view of the upper cylindrical collar or nipple ring, according to an exemplary embodiment.

FIGS. 22*a*-22*c* depict a top view, a side view, and a sectional view, respectively, of the upper cylindrical collar or dispensing member ring 222. At least a portion of the upper cylindrical collar 222 is ribbed or textured, as shown in FIGS. 22 and 22*b*, and has a maximum diameter 1.68 to 1.88 inches. In an alternative embodiment, the maximum diameter of the upper cylindrical collar 222 is 1.78 inches. The diameter of the top 224 of the upper cylindrical collar 222 has a smaller diameter than the ribbed section of 1.48 to 1.68 inches. In an alternative embodiment, the diameter of the top 224 of the upper cylindrical collar 22 is 1.58 inches. Further, the diameter of the top opening of the upper cylindrical collar or dispensing ring 222 for receiving the nipple 216 can be 0.82 to 1.02 inches. In an alternative embodiment, the diameter of the top opening of the upper cylindrical collar is 0.92 inches. The height of the upper cylindrical collar 222 can be 0.77 to 0.97 inches. In an alternative embodiment, the height of the upper cylindrical collar 222 is 0.87 inches.

Figure 23C:
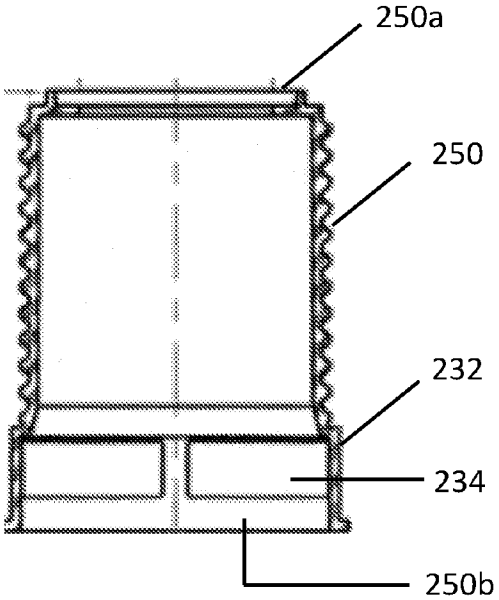
FIG. 23*c* depicts a sectional view of the storage area, according to the exemplary embodiments of FIGS. 23*a* and 23*b*.
Figure 23B:
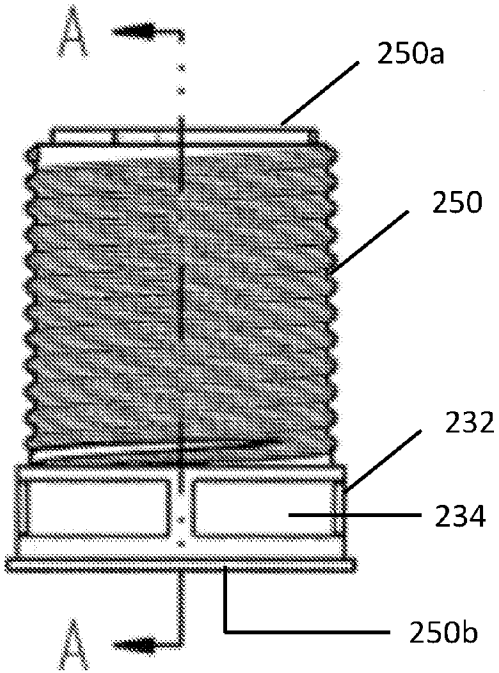
FIG. 23*b* depicts a side view of the storage area, according to the exemplary embodiment of FIG. 23*a*.
Figure 23A:
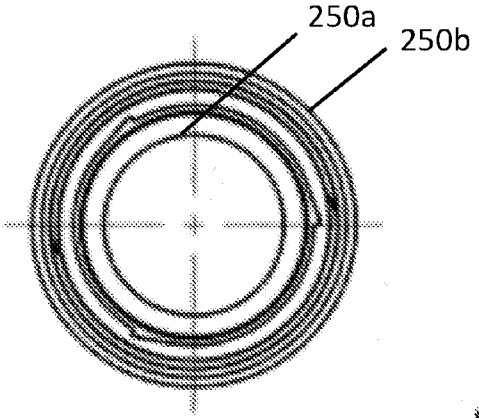
FIG. 23*a* depicts a top view of the storage area, according to an exemplary embodiment.

FIGS. 23*a*-23*c* depict a top view, a side view, and a sectional view, respectively, of the storage area 250. The maximum diameter of the storage area 250*b* or the diameter of the base of the storage area 250*b*, as shown in FIGS. 23*a*-23*c*, can be 1.56 to 1.76 inches. In an alternative embodiment, the maximum diameter of the storage area 250*b* is 1.66 inches. The diameter of the storage area threaded portion 250 can be 1.29 to 1.49 inches. In an alternative embodiment, the diameter of the storage area threaded portion 250 is 1.39 inches. Further, the smallest diameter of the storage area 250*a* or the diameter of the storage area above the threaded portion 250*a* can be 0.82 to 1.02 inches. In an alternative embodiment, the smallest diameter of the storage area 250*a* is 0.92 inches. The height of the storage area 250 including the top portion 250*a* and the base portion 250*b* can be 2.00 to 2.20 inches. In an alternative embodiment, the height of the storage area 250 including the top portion 250*a* and the base portion 250*b* is 2.10 inches. The height of the bottom of the storage area 250*b* including the legs 232 and the keyways 234 can be 0.39 to 0.59 inches. In an alternative embodiment, the height of the bottom of the storage area 250*b* is 0.49 inches.

Figure 24C:
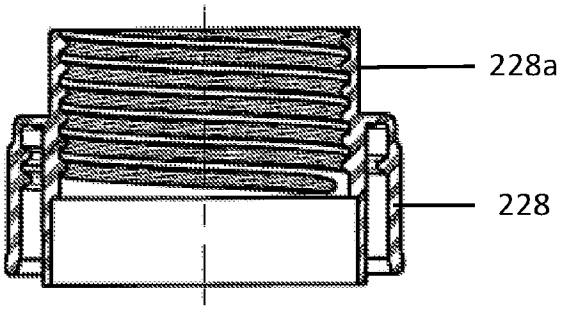
FIG. 24*c* depicts a sectional view of the lower cylindrical collar or bottle closure, according to the exemplary embodiments of FIGS. 24*a* and 24*b*.
Figure 24B:
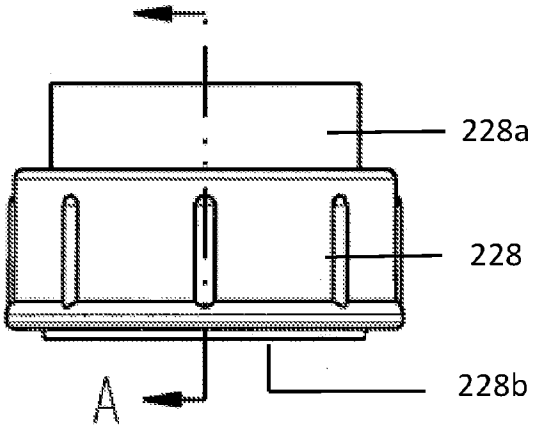
FIG. 24*b* depicts a side view of the lower cylindrical collar or bottle closure, according to the exemplary embodiment of FIG. 24*a*.
Figure 24A:
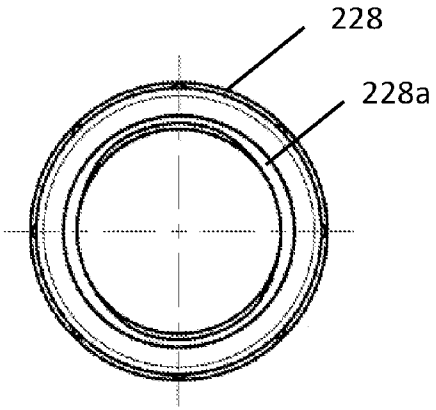
FIG. 24*a* depicts a top view of the lower cylindrical collar or bottle closure, according to an exemplary embodiment.

FIGS. 24*a*-24*c* depict a top view, a side view, and a sectional view, respectively, of the lower cylindrical collar 228. The maximum diameter of the lower cylindrical collar can be 1.94 to 2.14 inches. In an alternative embodiment, the maximum diameter of the lower cylindrical collar is 2.04 inches. The diameter of the top of the lower cylindrical collar 228*a* or bottle closure can be 1.48 to 1.68 inches. In an alternative embodiment, the diameter of the top of the lower cylindrical collar 228*a* is 1.58 inches. Further, the height of the lower cylindrical collar can be 1.2 to 1.4 inches. In an alternative embodiment, the height of the lower cylindrical collar is 1.3 inches. The height of the lower cylindrical collar 228 can be 0.71 to 0.91 inches, and the height of the lower cylindrical collar 228 including the base of the collar 228*b* can be 0.77 to 0.97 inches. In an alternative embodiment, the height of the lower cylindrical collar 228 is 0.81 inches, and the height of the lower cylindrical collar 228 including the base of the collar 228*b* is 0.87 inches. The diameter of the base of the lower cylindrical collar 228*b* can be 1.56 to 1.76 inches. In an alternative embodiment, the diameter of the base of the lower cylindrical collar 228*b* is 1.66 inches.

Figure 25A:
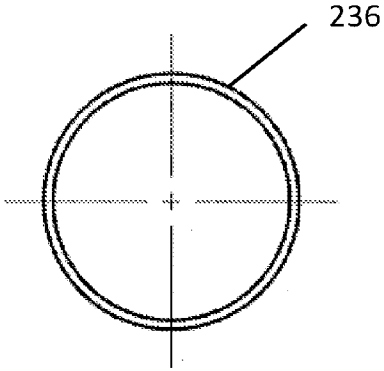
FIG. 25*a* depicts a top view of the storage area seal or end cap, according to an exemplary embodiment.

FIGS. 25*a*-25*c* depict a top view, a side view, and a sectional view, respectively, of the seal or end cap 236. The height of the seal or end cap 236, as shown in FIGS. 25*b*-25*c*, can be 0.57 to 0.77 inches. In an alternative embodiment, the height of the seal or end cap 236 is 0.67 inches. The diameter of the base 236*b* of the seal 236 can be 1.49 to 1.69 inches, and the diameter of the top portion 236*a* of the seal 236 can be 1.38 to 1.58 inches. In an alternative embodiment, the diameter of the base 236*b* of the seal 236 is 1.59 inches. The seal further includes L-shaped portions 238 arranged at each end of the seal 236, as shown in FIGS. 25*b* and 25*c*.

Figure 26A:
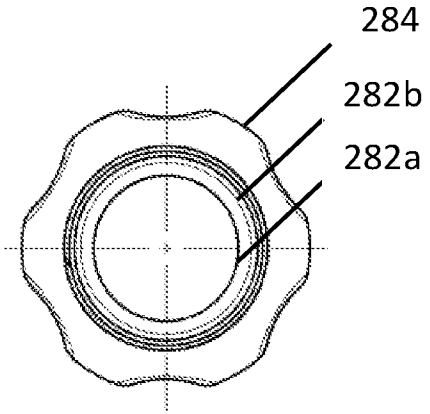
FIG. 26*a* depicts a top view of a bottle without a cap, according to an exemplary embodiment.

FIGS. 26*a* and 26*b* depict a top view and a side view of the bottle 282, respectively. The bottle 282, as shown in FIG. 26*b*, includes any number of depressed areas 280 forming thinner portions of the cylindrical wall. As shown in FIGS. 26*a* and 26*b*, the top portion 282*b* of the bottle 282 has a threaded portion 282*a*. An inner portion of the cap lower cylindrical collar 226 is arranged to rotate around the outer portion 282*a* and 282*b* of the bottle 282. The height of the bottle portion (without the cap), as shown in FIG. 26*b*, can be 5.7 to 5.9 inches. In an alternative embodiment, the height of the bottle portion is 5.8 inches.

It will be understood that many additional changes in the details, materials, steps and arrangement of parts, which have been herein described and illustrated to explain the nature of the subject matter, may be made by those skilled in the art within the principle and scope of the invention as expressed in the appended claims.

What is claimed is:

1. A dispensing cap comprising:

a dispensing member in a top of the dispensing cap, the dispensing member including an aperture defining a dispensing member opening;

a static plug centrally positioned within the dispensing member;

a dispensing cap body having an upper cylindrical collar having an upper cylindrical collar inner threaded side wall, a lower cylindrical collar having a first lower cylindrical collar inner threaded side wall and a second lower cylindrical collar inner threaded side wall, and a storage tube inside of the dispensing cap body and configured to store liquid or powder contents, the storage tube having a storage tube outer threaded side wall arranged to threadedly engage the first lower cylindrical collar inner threaded side wall and the upper cylindrical collar inner threaded side wall;

wherein the upper cylindrical collar inner threaded side wall rotates in a clockwise and a counterclockwise direction, the upper cylindrical collar having a textured surface thereby providing a gripping mechanism for rotating the upper cylindrical collar in threaded engagement with the storage tube;

wherein the second lower cylindrical collar inner threaded side wall rotates in a clockwise and a counterclockwise direction around an upper outer surface of a container, wherein the lower cylindrical collar is in threaded engagement with the storage tube and upper outer surface; and a seal disposed at a bottom of the storage tube and arranged to prevent a release of the storage tube liquid or powder contents, wherein the clockwise rotation and threaded engagement of the storage tube with the lower cylindrical collar and the upper cylindrical collar releases the seal from the storage tube such that rotational forces aided by gravitational forces dispense the liquid or powder contents out keyways of the storage tube into the container; wherein: the upper cylindrical collar is rotatable in the clockwise direction in relation to the container to cause the storage tube outer threaded side wall, the first lower cylindrical collar inner threaded side wall, and the upper cylindrical collar inner threaded side wall to threadedly engage while releasing the seal away from a locked position; and the upper cylindrical collar is rotatable in the counterclockwise direction in relation to the container to cause the storage tube outer threaded side wall, the first lower cylindrical collar inner threaded side wall, and the upper cylindrical collar inner threaded side wall to disengage while moving the seal to the locked position.

2. The dispensing cap of claim 1, wherein the dispensing member is assembled to be manually raised to a higher position than the static plug, thereby providing a channel for contents of the storage tube and container to be dispensed.

3. The dispensing cap of claim 1, wherein the dispensing member is configured in a shape of a cylindrical sipper or nozzle.

4. The dispensing cap of claim 1, wherein at least a portion of the upper cylindrical collar is ribbed, and wherein at least a portion of the lower cylindrical collar is textured and/or ribbed, thereby providing a gripping mechanism for rotating the lower cylindrical collar with respect to the container.

5. The dispensing cap of claim 1, further comprising the seal assembled with attaching members, the seal configured to form the keyways of the storage tube, thereby providing areas for the storage tube liquid and powder contents to fall from the storage tube and into the container, and wherein the seal is one of a substantially conical, pyramidal, or flat shape.

6. A dispensing cap comprising:

a dispensing member in a top of the dispensing cap, the dispensing member including an aperture defining a dispensing member opening;

a dispensing cap body having an upper cylindrical collar having an upper cylindrical collar inner threaded side wall, a lower cylindrical collar having a first lower cylindrical collar inner threaded side wall and a second lower cylindrical collar inner threaded side wall, and a storage tube inside of the dispensing cap body and configured to store liquid or powder contents, the storage tube having a storage tube outer threaded side wall arranged to threadedly engage the first lower cylindrical collar inner threaded side wall and the upper cylindrical collar inner threaded side wall;

wherein the upper cylindrical collar inner threaded side wall rotates in a clockwise and a counterclockwise direction, the upper cylindrical collar having a textured surface thereby providing a gripping mechanism for rotating the upper cylindrical collar in a threaded engagement;

wherein the second lower cylindrical collar inner threaded side wall rotates in a clockwise and a counterclockwise direction around an upper outer surface of a container, wherein the lower cylindrical collar and upper outer surface are in threaded engagement; and a seal disposed at a bottom of the storage tube and arranged to prevent a release of the storage tube liquid or powder contents, wherein the clockwise rotation and threaded engagement of the storage tube with the lower cylindrical collar and the upper cylindrical collar releases the seal from the storage tube such that rotational forces within the dispensing cap urge the storage tube liquid or powder contents from the storage tube into the container; wherein: the upper cylindrical collar is rotatable in the clockwise direction in relation to the container to cause the storage tube outer threaded side wall, the first lower cylindrical collar inner threaded side wall, and the upper cylindrical collar inner threaded side wall to threadedly engage while releasing the seal away from a locked position; and the upper cylindrical collar is rotatable in the counterclockwise direction in relation to the container to cause the storage tube outer threaded side wall, the first lower cylindrical collar inner threaded side wall, and the upper cylindrical collar inner threaded side wall to disengage while moving the seal to the locked position.

7. The dispensing cap of claim 6, wherein the dispensing member is configured in the shape of an applicator or nozzle and configured to dispense the combined contents of the storage tube and container when the container is tilted to a non-upright position and/or pressure is applied about the container.

8. The dispensing cap of claim 6, wherein at least a portion of the upper cylindrical collar is ribbed.

9. The dispensing cap of claim 6, wherein the lower cylindrical collar is smooth and/or textured.

10. The dispensing cap of claim 6, wherein the lower cylindrical collar is ribbed.

11. The dispensing cap of claim 6, wherein the seal is of a substantially flat shape.

12. A dispensing cap comprising:

a dispensing member in a top of the dispensing cap, the dispensing member including an aperture defining a dispensing member opening;

a dispensing cap body having an upper cylindrical collar, a lower cylindrical collar, and a storage tube inside of the dispensing cap body and configured to store liquid or powder contents;

wherein the upper cylindrical collar having a threaded inner surface rotates in a clockwise and a counterclockwise direction, the upper cylindrical collar having a textured surface thereby providing a gripping mechanism for rotating the upper cylindrical collar in a threaded engagement;

wherein the lower cylindrical collar having a threaded inner surface rotates in a clockwise and a counterclockwise direction around an upper outer surface of a container, wherein the lower cylindrical collar and upper outer surface are in threaded engagement; and a seal disposed at a bottom of the storage tube and arranged to prevent a release of the storage tube liquid or powder contents, wherein the clockwise rotation and threaded engagement of the storage tube with the lower cylindrical collar and the upper cylindrical collar releases the seal from the storage tube such that rotational forces within the dispensing cap urge the storage tube liquid or powder contents from the storage tube into the container; wherein: the upper cylindrical collar is rotatable in the clockwise direction in relation to the container to cause a storage tube outer threaded side wall, the lower cylindrical collar inner threaded side wall, and the upper cylindrical collar inner threaded side wall to threadedly engage while releasing the seal away from a locked position; and the upper cylindrical collar is rotatable in the counterclockwise direction in relation to the container to cause the storage tube outer threaded side wall, the lower cylindrical collar inner threaded side wall, and the upper cylindrical collar inner threaded side wall to disengage while moving the seal to the locked position.

13. The dispensing cap of claim 12, wherein the dispensing member is configured in the shape of a nipple and configured to dispense the combined contents of the storage tube and container when the container is both tilted to a non-upright position and/or pressure is applied about the container.

14. The dispensing cap of claim 12, wherein at least a portion of the upper cylindrical collar is ribbed, and wherein at least a portion of the lower cylindrical collar is textured and/or ribbed, thereby providing a gripping mechanism for rotating the lower cylindrical collar with respect to the container.

15. The dispensing cap of claim 12, further comprising the seal assembled with attaching members, the seal configured to form keyways of the storage tube, thereby providing areas for the storage tube liquid and powder contents to fall from the storage tube and into the container, and wherein the seal is one of a substantially conical, pyramidal, or flat shape.

* * * * *